US007991220B2

(12) United States Patent
Nagai et al.

(10) Patent No.: US 7,991,220 B2
(45) Date of Patent: Aug. 2, 2011

(54) AUGMENTED REALITY GAME SYSTEM USING IDENTIFICATION INFORMATION TO DISPLAY A VIRTUAL OBJECT IN ASSOCIATION WITH A POSITION OF A REAL OBJECT

(75) Inventors: Nobuki Nagai, Kanagawa (JP); Tetsuya Watanabe, Tokyo (JP); Yusuke Iida, Tokyo (JP); Takahisa Suzuki, Kanagawa (JP)

(73) Assignee: Sony Computer Entertainment Inc., Tokyo (JP)

( * ) Notice: Subject to any disclaimer, the term of this patent is extended or adjusted under 35 U.S.C. 154(b) by 1042 days.

(21) Appl. No.: 11/661,585

(22) PCT Filed: May 25, 2005

(86) PCT No.: PCT/JP2005/009547

§ 371 (c)(1),
(2), (4) Date: Jul. 24, 2007

(87) PCT Pub. No.: WO2006/025137

PCT Pub. Date: Mar. 9, 2006

(65) Prior Publication Data

US 2008/0100620 A1 May 1, 2008

(30) Foreign Application Priority Data

Sep. 1, 2004 (JP) ..... 2004-254886
Sep. 1, 2004 (JP) ..... 2004-254887

(51) Int. Cl.
*G06K 9/00* (2006.01)
*G09G 5/00* (2006.01)

(52) U.S. Cl. ..... 382/154; 382/103; 345/633

(58) Field of Classification Search ..... None
See application file for complete search history.

(56) References Cited

U.S. PATENT DOCUMENTS 6,750,848 B1 * 6/2004 Pryor ..... 345/168
2003/0062675 A1 * 4/2003 Noro et al. ..... 273/237
2005/0276444 A1 * 12/2005 Zhou et al. ..... 382/103

FOREIGN PATENT DOCUMENTS

JP 9-115004 5/1997
JP 2000-102036 4/2000

(Continued)

OTHER PUBLICATIONS

International Search Report dated Sep. 6, 2005, for corresponding International Application No. PCT/JP2005/009547.

(Continued)

*Primary Examiner* — Bhavesh M Mehta
*Assistant Examiner* — Barry Drennan
(74) *Attorney, Agent, or Firm* — Katten Muchin Rosenman LLP

(57) ABSTRACT

An image processing technology for displaying a real object and a virtual object associated with each other is provided. An image analysis apparatus according to the present invention changes a motion pattern of the virtual object depending on the actual movement of the real object. The change detector 110 detects temporal state change in the motion pattern of the real object captured by an imaging apparatus and the display controller 120 reads a motion pattern from the motion pattern storage 122 based on the event generated by the state change of an image. The display pattern controller 122 controls display mode of the virtual object using the read motion pattern.

26 Claims, 21 Drawing Sheets

FOREIGN PATENT DOCUMENTS

| | | | |
|---|---|---|---|
| JP | 2000-322602 | | 11/2000 |
| JP | 2000-353248 | | 12/2000 |
| JP | 2003-103052 | | 4/2003 |
| JP | 2003-219424 | | 7/2003 |
| JP | 2003-256876 | * | 9/2003 |

OTHER PUBLICATIONS

Toshikazu Oshima, et al., "RV-Border Guards:A Multiplayer Mixed Reality Entertainment," The Virtual Reality Society of Japan Monograph, Dec. 31, 1999, vol. 4, No. 4, pp. 699-705, Japan.

Hideyuki Tamura, et al. "Mixed Reality and Vision Technique," O plus E, New Technology Communications, Dec. 5, 2002, vol. 24, No. 12 pp. 1372-1377, Japan.

Kenji Imamoto, et al., "A Study on Communication in Collaborative Augmented Reality Environment with Virtual Object Manipulation Task," IEICE Technical Report HIP 2001-78-91 Human Information Processing, The Institute of Electronics, Information and Communication Engineers, Jan. 17, 2002, vol. 101, No. 594, pp. 31-36, Japan.

International Preliminary Report on Patentability dated Mar. 20, 2007, for corresponding International Patent Application No. PCT/JP2005/009547.

Notification of Reason(s) for Refusal dated Aug. 23, 2005, for corresponding Japanese Patent Application No. 2004-254887.

Decision of Refusal dated Apr. 18, 2006, for corresponding Japanese Patent Application No. 2004-254887.

Notification of Reason(s) for Refusal dated Aug. 23, 2005, for corresponding Japanese Patent Application No. 2004-254886.

Decision of Refusal dated Apr. 18, 2006 for corresponding Japanese Patent Application No. 2004-254886.

Notification of Reason(s) for Refusal dated Sep. 16, 2008 from the corresponding Japanese Application No. 2006-164041.

Kenji Imamoto, et. al., "A Study on Communication in Collaborative Augmented Reality Environment with Virtual Object Manipulation Task", Technical Report of IEICE, HIP2001(83)(2002-1), Jan. 17, 2002, pp. 31-36, vol. 101, No. 594, The Institute of Electronics, Information and Communication Engineers (IEICE), Japan.

Toshikazu Ohshima, et. al., "RV-Border Guards: A Multi-player Mixed Reality Entertainment", Transaction of Virtual Reality Society of Japan, Dec. 31, 1999, pp. 699-705, vol. 4, No. 4, Virtual Reality Society of Japan, Japan.

Decision of Refusal dated Dec. 9, 2008, from the corresponding Japanese Application.

Motoyuki Ozeki, et al. "Automated Camera Control for Capturing Desktop Manipulations", IEICE Transaction (J86-D-II), Information system II-pattern processing, Japan, IEICE, Nov. 1, 2003, vol. J86-D-II, No. 11, pp. 1606-1617.

Jun Ohya, et al. "Research on Virtual Communication Environments at ATR" Technical Report of IEICE, The Institute of Electronics, Information and Communication Engineers, Jan. 20, 2001, vol. 99, No. 574, pp. 79-84.

* cited by examiner

FIG.13

| IDENTIFICATION NUMBER | STAGE 1 | STAGE 2 |
|---|---|---|
| 1 | MAN | MAN |
| 2 | WOMAN | WOMAN |
| 3 | DRUM | DOORS OF RESTAURANT |
| 4 | RESTAURANT BUILDING | WAITOR |
| 5 | POSTOFFICE BUILDING | TABLE AND CHAIRS |

306

AUGMENTED REALITY GAME SYSTEM USING IDENTIFICATION INFORMATION TO DISPLAY A VIRTUAL OBJECT IN ASSOCIATION WITH A POSITION OF A REAL OBJECT

This application is a National Phase Application of International Application No. PCT/JP2005/009547, filed May 25, 2005, which claims the benefit under 35 U.S.C. 119 (a-e) of Japanese Application No. 2004-254886 filed Sep. 1, 2004, and Japanese Application No. 2004-254887 filed Sep. 1, 2004, which is herein incorporated by reference.

FIELD OF THE INVENTION

The present invention relates to a technology for processing an image, and more specifically, to a technology for displaying an image where a real object and a virtual object are associated.

BACKGROUND TECHNOLOGY

Recently, the technology is widely available for capturing an image of a two-dimensional code by a camera for recognition and allowing a predetermined process associated with the code pattern to be performed. As one of those techniques, an image analysis technique is proposed which captures two-dimensional barcode using a video camera and displays a three-dimensional image corresponding to a two-dimensional barcode on a displaying device (e.g. Japanese Laid-Open Publication No. 2000-322602). According to the Japanese Laid-Open Publication No. 2000-322602, a spatial coordinate where a three-dimensional object is displayed is determined based on the coordinate of captured two-dimensional barcode and a focal distance of a CCD video camera and a three-dimensional image is superimposed on the two-dimensional barcode.

DISCLOSURE OF THE INVENTION

Problem to be Solved by the Invention

The technique disclosed in Japanese Laid-Open Publication No, 2000-322602 allows realizing excellent visual effects by displaying a real object and a virtual object combined. However, the Japanese Laid-Open Publication No. 2000-322602 only discloses a displaying technique of a virtual object when a two-dimensional barcode remains at rest. Thus the document does not show awareness of display processing of a virtual object when a two-dimensional barcode is moved. The present inventor has focused on display processing when a two-dimensional barcode is moved and found out the possibility of realizing a still more excellent visual effect by devising display processing of a virtual object and applying the display processing to a field of moving images, for example, a game.

The document only discloses a displaying technique of a virtual object associated with a single two-dimensional barcode. Thus it does not show awareness of display processing with a plurality of two-dimensional barcodes. The present inventor has focused attention on display processing when a plurality of real objects, such as two-dimensional barcodes, exist in real space, and found out the possibility of realizing a still more excellent visual effect by devising display processing of a virtual object and applying the display processing to, for example, a game.

A general purpose of the present invention is to provide a technique for establishing association and displaying a real object and a virtual object, especially to provide a technique for controlling a virtual object when displayed in relation to the movement of a real object, in a field of moving images, for example, a game.

Another general purpose of the present invention is to provide a technique for establishing association and displaying a real object and a virtual object, especially to provide a technique for controlling a virtual object when displayed based on the positional relation of a plurality of real objects.

Means to Solve the Problem

In this background, an image processing apparatus according to at least one embodiment of the present invention comprises: a storage which stores identification information for identifying a real object and three-dimensional image data of a virtual object associated with each other; a reader which reads three-dimensional image data of a virtual object associated with identification information on an image of the real object included in a frame image captured by an imaging apparatus from the storage; a display controller which displays the virtual object in association with a displayed position of the real object using read three-dimensional image data; and a change detector which detects a temporal state change of an image of a real object captured by the imaging apparatus. In the image processing apparatus, the display controller controls the virtual object as displayed based on a state change detected by the change detector. The term "a real object" means an object existing in real space as tangible goods, and the term "a virtual object" means a non-existing object in real space, which is represented by data in virtual space.

The image processing apparatus provides a new visual effect of a virtual object associated with the motion of a real object since the displayed virtual object is controlled based on the state change of a captured real object image (i.e., an actual motion of the real object).

A game apparatus according to at least one embodiment of the present invention comprises: a storage which stores identification information for identifying a real object and three-dimensional image data of a game character associated with each other; a reader which reads three-dimensional image data of a game character associated with identification information on an image of a real object included in a frame image captured by an imaging apparatus from the storage; a display controller which displays the game character in association with a displayed position of the real object using read three-dimensional image data; and a change detector which detects a temporal state change of an image of a real object captured by the imaging apparatus. In the game apparatus, the display controller controls the game character as displayed based on the state change detected by the change detector.

This game apparatus provides a new visual effect of a game character associated with the motion of a real object since the displayed game character is controlled based on the state change of a captured real object image (i.e., the motion of the real object).

An image processing method according to at least one embodiment of the present invention comprises: reading three-dimensional image data of a virtual object associated with identification information on an image of a real object included in a frame image captured by an imaging apparatus from a storage which stores identification information for identifying a real object and three-dimensional image data of a virtual object associated with each other; displaying a virtual object, establishing association with a displayed position of the real object, using read three-dimensional image data; detecting a temporal state change of an image of a real object captured by the imaging apparatus; and controlling the virtual object as displayed based on the detected state change.

A computer program product according to at least one embodiment of the present invention comprises; a reading module which reads three-dimensional image data of a virtual object associated with identification information on an image of a real object included in a frame image captured by an imaging apparatus from a storage which stores identification information for identifying a real object and three-dimensional image data of a virtual object associated with each other; a displaying module which displays a virtual object, establishing association with a displayed position of the real object, using read three-dimensional image data; a detecting module which detects a temporal state change of an image of a real object captured by the imaging apparatus; and a controlling module which controls the virtual object as displayed based on the detected state change.

An image processing apparatus according to at least one embodiment of the present invention comprises: a storage which stores identification information for identifying a real object and three-dimensional image data of a virtual object associated with each other; a positional relation detector which detects a positional relation among a plurality of real object images included in a frame image captured by an imaging apparatus; a condition evaluator which determines whether the detected positional relation among at least two of real object images fulfills a predefined condition; a reader which reads three-dimensional image data of a plurality of virtual object images associated with identification information on a plurality of real objects included in a frame image captured by the imaging apparatus; and a display controller which, in case the condition evaluator determines that the predefined condition is fulfilled, determines a displaying pattern of a virtual object based on identification information on at least two real object images which fulfills the predefined condition and performs display processing of a virtual object according to the determined display pattern, using a plurality of pieces of read three-dimensional image data. The term "a real object" means an object existing in real space as tangible goods, and the term "a virtual object" means a non-existing object in real space, which is represented by data in virtual space.

According to the image processing apparatus, new visual effect of a virtual object is provided by placing a plurality of real objects in a pre-determined positional relation since the image processing apparatus controls the virtual object as displayed based on the positional relation among a plurality of captured real object images.

A game apparatus according to at least one embodiment of the present invention comprises: a storage which stores identification information for identifying a real object and three-dimensional image data of a game character associated with each other; a positional relation detector which detects a positional relation among a plurality of real object images included in a frame image captured by an imaging apparatus; a condition evaluator which determines whether the detected positional relation among at least two real object images fulfills a predefined condition; a reader which reads three-dimensional image data of a plurality of game characters associated with identification information on a plurality of real objects included in a frame image captured by an imaging apparatus; and a display controller which, in case the condition evaluator determines that the predefined condition is fulfilled, determines a displaying pattern of a game character based on identification information on at least two real object images which fulfill a predefined condition and performs display processing of a game character according to the determined display pattern, using a plurality of pieces of read three-dimensional image data.

According to the game apparatus, a new visual effect of a game character is provided by placing a plurality real objects in a pre-determined positional relation since the game apparatus controls the game character as displayed based on the positional relation among a plurality of captured real object images.

An image processing method according to at least one embodiment of the present invention comprises: detecting a positional relation among a plurality of real object images included in a frame image captured by an imaging apparatus; determining whether the detected positional relation among at least two of real object images fulfills a predefined condition; reading three-dimensional image data of a plurality of virtual objects associated with identification information on a plurality of real objects included in a frame image; determining a displaying pattern of a virtual object based on identification information on at least two real object images which fulfill the predefined condition, in case the predefined condition is determined to be fulfilled; and performing display processing of a virtual object according to the determined display pattern, using a plurality of pieces of read three-dimensional image data.

A computer program product according to at least one embodiment of the present invention comprises: a detecting module which detects a positional relation among a plurality of real object images included in a frame image captured by an imaging apparatus; a determining module which determines whether the detected positional relation among at least two of real object images fulfills a predefined condition; a reading module which reads three-dimensional image data of a plurality of virtual objects associated with identification information on a plurality of real object images included in a frame image from a storage which stores identification information for identifying a real object and three-dimensional image data of a virtual object associated with each other; a determining module which determines displaying pattern of a virtual object based on identification information on at least two real object images which fulfill a predefined condition, in case the predefined condition is determined to be fulfilled; and a performing module which performs display processing of a virtual object according to the determined display pattern, using a plurality of pieces of three-dimensional image data read from the storage.

Optional combinations of the aforementioned constituting elements, and implementations of the invention in the form of methods, apparatuses, systems, recording mediums and computer programs may also be practiced as additional modes of the present invention.

The present invention enables to provide a technique for controlling a virtual object relating to a real object.

The present invention enables to provide a technique for controlling a virtual object based on positional relation of a plurality of real objects.

BRIEF DESCRIPTION OF THE DRAWINGS

FIG. 13 shows the stored contents of character storage

DESCRIPTION OF THE REFERENCE NUMERALS

1 . . . game system, 4 . . . game card, 10 . . . image processing apparatus, 20 . . . image analysis apparatus, 30 . . . game apparatus, 40 . . . frame image acquirer 42 . . . real object extractor, 44 . . . state determiner, 46 . . . identification information acquirer, 48 . . . identification information storage, 50 . . . transmitting unit, 52 . . . attitude determiner, 54 . . . orientation determiner, 56 . . . distance determiner, 100 . . . analysis information acquirer, 102 . . . game progress processor, 104 . . . character determiner, 106 . . . character storage, 110 . . . change detector, 112 . . . movement quantity monitoring unit, 114 . . . rotation detector, 116 . . . existence recognizer, 120 . . . display controller, 122 . . . motion pattern storage, 201 . . . game system, 210 . . . image processing apparatus, 220 . . . image analysis apparatus, 230 . . . game apparatus, 240 . . . frame image acquirer, 242 . . . real object extractor, 244 . . . state determiner, 246 . . . identification information acquirer, 248 . . . identification information storage, 250 . . . transmitting unit, 252 . . . position determiner, 254 . . . orientation determiner, 256 . . . distance determiner, 300 . . . analysis information acquirer, 302 . . . game progress processor, 304 . . . character determiner, 306 . . . character storage, 310 . . . positional relation detector, 312 . . . condition evaluator, 320 . . . display controller, 322 . . . display pattern storage

BEST MODE FOR CARRYING OUT THE INVENTION

First Embodiment

Figure 1:
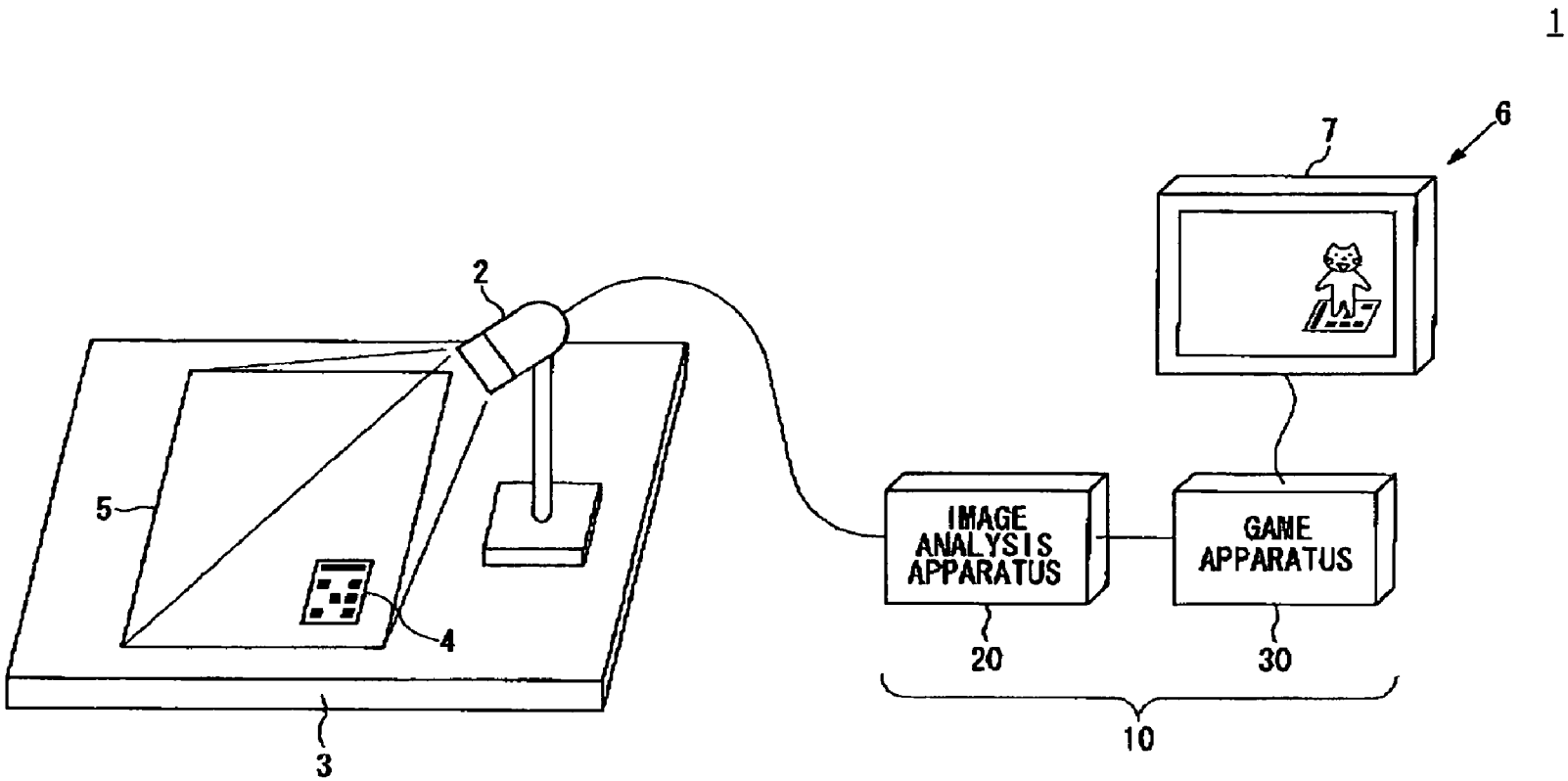
FIG. 1 shows the structure of a game system according to one exemplary embodiment of the invention.

The first embodiment of the present invention provides a technique wherein a temporal state change of a real object image captured by an imaging apparatus is detected and a mode, for example an appearance, of displaying virtual object is controlled based on the detected change. A real object may be a one-dimensional object, a two-dimensional object or a three-dimensional object. It is favorable that a real object be provided with a distinctive part that identifies the real object. For example, a real object may be a two-dimensional object, such as a card that is provided with two-dimensionally represented coded information as a distinctive part, or a three-dimensional object with uniquely shaped three-dimensional part as a distinctive part. A two-dimensional shape of a two-dimensional object may constitute a unique distinctive part or distinctive coded information may be affixed on a three-dimensional object. A virtual object may be, so to say, a character, such as a person, an animal or material goods that is represented three-dimensionally in virtual space. The first embodiment described below relates to an image processing technology in a game application and adopts a game character presented in a game application as a virtual object FIG. 1 shows the structure of a game system 1 according to the first embodiment. The game system 1 is provided with an imaging apparatus 2, an image processing apparatus 10 and an output apparatus 6. The image processing apparatus 10 is provided with an image analysis apparatus 20 and a game apparatus 30. The image analysis apparatus 20 and the game apparatus 30 may be separate apparatuses or may be integrally combined. The imaging apparatus 2 is embodied by a video camera comprising a charge coupled device (CCD) imaging element, a metal oxide semiconductor (MOS) imaging element or the like. The imaging apparatus 2 captures an image of real space periodically so as to generate a frame image in each period. An imaging area 5 represents a range captured by the imaging apparatus 2. The position and size of the imaging area 5 are adjusted by adjusting the height and orientation of the imaging apparatus 2. A game player manipulates a game card 4, a real object, in the imaging area 5. The game card 4 is provided with a distinctive part that uniquely identifies the card.

The output apparatus 6 is provided with a display 7. The output apparatus 6 may also be provided with a speaker (not shown). The image processing apparatus 10 causes the display 7 to display a frame image captured by the imaging apparatus 2. In this process, the image processing apparatus 10 controls a character, a virtual object, to be superimposed on the game card 4 when displayed. The player can easily recognize whether the game card 4 is located within the imaging area 5 by watching the display 7. If the game card 4 is not located within the imaging area 5, the player may allow the imaging apparatus 2 to capture the image of the game card 4 by shifting the position of the game card 4 or by adjusting the orientation of the imaging apparatus 2.

In the game application according to the first embodiment, the player moves a character by manipulating the game card 4. As called for by the nature of the game application, it is favorable that the player feel the sense of unity between the game card 4 and the character. For this purpose, the image of the character is superimposed on the game card 4. As the player moves the game card 4 slowly in the imaging area 5, the character tracks the movement of the game card 4, remaining placed on the game card 4.

The character's motion is controlled by the image processing apparatus 10. First, the image analysis apparatus 20 extracts image information for the game card 4 from the frame image captured by the imaging apparatus 2. The image analysis apparatus 20 further extracts the unique distinctive part to identify the game card 4 from the image information on the game card 4. In this process, the image analysis apparatus 20 determines attitude information, orientation information and distance information on the game card 4 in space, by referring to the image information on the game card 4.

Figure 2:
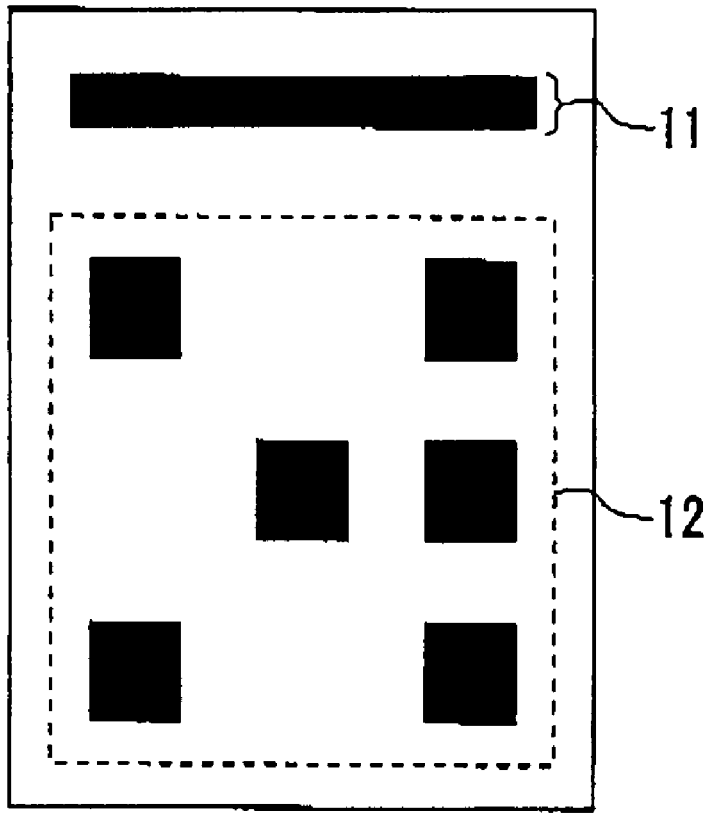
FIG. 2 shows an example of the surface of a game card.

FIG. 2 shows an exemplary two-dimensional code printed on the surface of a game card 4. An orientation indicator 11 and an identification indicator 12 are printed on the surface of the game card 4. The orientation indicator 11 is provided to indicate the front side of the game card 4 and the identification indicator 12 is provided to represent a distinctive field to identify the card uniquely. An identification indicator 12 is coded information made by a plurality of blocks printed on a predetermined field. Of the plurality of blocks, four corner blocks are given to a plurality of game cards 4 commonly. Thus actually, a distinctive part is comprised of blocks other than the four corner blocks. The four corner blocks are used to measure a distance from an imaging apparatus 2.

Referring back to FIG. 1, the image processing apparatus 20 determines the distance between the imaging apparatus 2 and the game card 4 from the length between the four corner blocks in the image of the game card 4 identified in the frame image. The image processing apparatus 20 further determines the orientation of the game card 4 by using the orientation indicator 11. In this case, the orientation indicator defines the front side and the character is controlled so that the character faces forward when displayed on the game card 4. The image analysis apparatus 20 also acquires identification information on the game card 4 by referring to an array of blocks other than the four corner blocks.

While FIG. 1 shows a state in which the game card 4 is put on a table 3, the game card 4 may be inclined with respect to the table 3, or may be elevated from the table 3. The image analysis apparatus 20 has the function of recognizing the inclined position of the game card 4 or variation in the height of the game card 4 with respect to the table 3, through image analysis. The result of image analysis by the image analysis apparatus 20 is sent to the game apparatus 30. The frame image captured by the imaging apparatus 2 may be sent to the game apparatus 30 for image analysis by the game apparatus 30. In this case, the image processing apparatus 10 may be formed only of the game apparatus 30.

The game apparatus 30 controls the character to be displayed on the game card 4 on the screen of the display 7 based on the result of image analysis by the image analysis apparatus 20. A character may be assigned to each game scene for a game card 4 as appropriate. In this case, when game scenes are switched, displayed characters are also changed. In the first embodiment, the game apparatus 30 detects a change over time of the captured game card image through imaging analysis results. Based on the state change, the game apparatus 30 controls display mode, for example an appearance, of a character.

Figure 3:
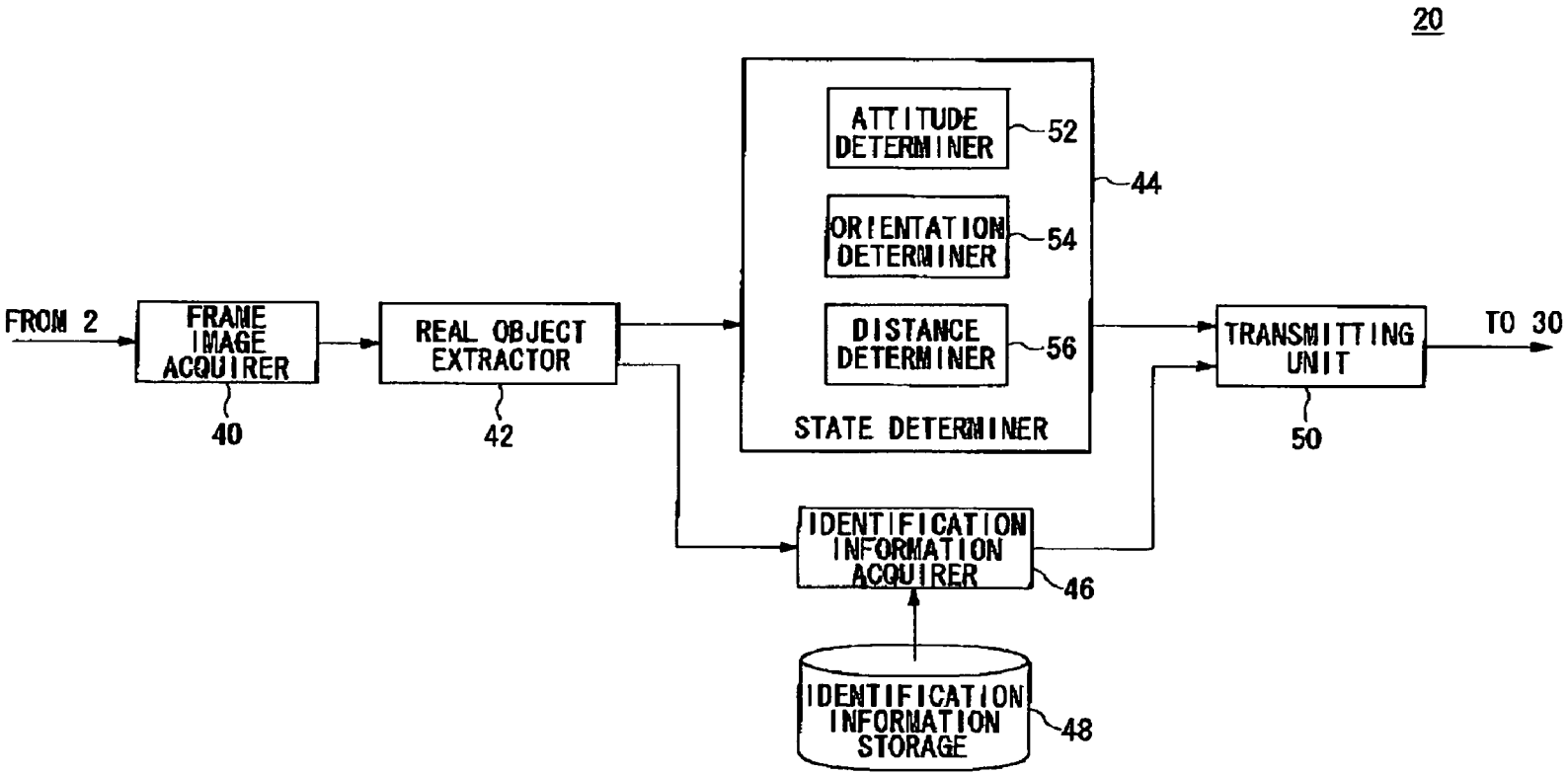
FIG. 3 shows the structure of an image analysis apparatus.

FIG. 3 shows the structure of the image analysis apparatus. The image analysis apparatus 20 is provided with a frame image acquirer 40, a real object extractor 42, a state determiner 44, an identification information acquirer 46, an identification information storage 48 and a transferring unit 50. The identification information storage 48 stores information on a distinctive field for identifying a real object and identification information for identifying the real object with each other. To be more specific, the identification information storage 48 stores pattern information on the identification indicator 12 and identification information in a one-to-one relationship. Identification information is used to allot a character in the game apparatus 30. Especially, in a game application that allows a plurality of game cards 4 to exist, associating respective game card 4 with identification information allows to recognize each game cards 4. The state determiner 44 determines the state of the real object in the defined coordinate system. More specifically, the state determiner 44 is provided with an attitude determiner 52 which determines the attitude of a card, an orientation determiner 54 which determines the orientation of a card and a distance determiner 56 which determines the focal distance from the imaging apparatus 2.

The frame image acquirer 40 acquires a frame image of real space captured by the imaging apparatus 2. Given that one game card is placed in the imaging area 5 here, as shown in FIG. 1. The imaging apparatus 2 captures a frame image at regular intervals. Preferably, the imaging apparatus 2 generates frame images at intervals of 1/60 second.

The real object extractor 42 extracts a real object image, i.e., an image of the game card 4, from the frame image. This process is performed by translating image information into binary bit representation and extracting the image of the game card 4 from binary bit representation (i.e. dot processing). Extracting an image may be performed by detecting ons and offs of a bit. This process may also be performed by a known image matching technology. In this case, the real object extractor 42 registers image information on a real object to be used in a memory (not shown) beforehand. Matching registered image information and captured image information allows cutting out an image of a game card 4 from the frame image.

The attitude determiner 52 determines the attitude of the real object image. More specifically, the attitude determiner 52 determines the coordinate of the center point of the real object image, the inclination of the real object image with respect to the table 3, height of the real object image from the table 3 and the like. For that purpose, the state determiner 44 detects geometry information of the table 3 on which the game card 4 is placed and moved beforehand. The state determiner 44 further defines the surface of the table 3 as a reference plane and records geometry information on the attitude of the game card 4 placed on the reference plane as the initial attitude of the game card 4. This geometry information may be formed with reference to the imaging apparatus 2. The state determiner 44 maintains the position, the attitude and the like of the table 3 as coordinate data in imaging space from the geometry information acquired of table 3. The attitude determiner 52 determines the inclination and height of the game card 4 with respect to the reference plane as a difference in relative quantity of state from the attitude of the game card 4 recorded as the initial state (i.e., difference of coordinate values in imaging space). In case a player picks up or inclines the game card 4, change in quantity of state in reference to the initial attitude occurs and the height and the inclination of the real object image with respect to the table 3 change.

The orientation determiner 54 determines the orientation of the real object image. The orientation determiner 54 may detect the orientation indicator 11 shown in FIG. 2 from the real object image and determine the orientation of the real object. The orientation determiner 54 may also determines the orientation of the real object as the orientation of inclination in case the inclination of the real object is recognized by the altitude determiner 52.

The distance determiner determines the distance between the imaging apparatus 2 and the game card 4 from the length among the four corners of the identification indicator 12 in the image of the game card 4.

The identification information acquirer 46 extracts a distinctive feature from the real object image and acquires a corresponding identification information from the identification information storage 48. While FIG. 1 shows one game card 4, the game system 1 according to the first embodiment is compatible with a plurality of game cards 4. For example, in case five game cards 4 are allowed to be used at the same time, identification information 1 to 5 may be allotted to respective game card.

Attitude information, orientation information, distance information determined in the state determiner 44 and identification information acquired by the identification acquirer 46 are associated with each other and transmitted to the game apparatus 30 from the transmitting unit 50. If a plurality of game cards 4 exist within the imaging area 5, altitude information, orientation information, distance information and identification information on each game card 4 are associated with each other before being transmitted to the game apparatus 30 from the transmitting unit 50. Since the frame image captured by the imaging apparatus 2 is displayed on the display 7, the frame image itself is also transmitted to the game apparatus 30 from the transmitting unit 50 according to the first embodiment.

Figure 4:
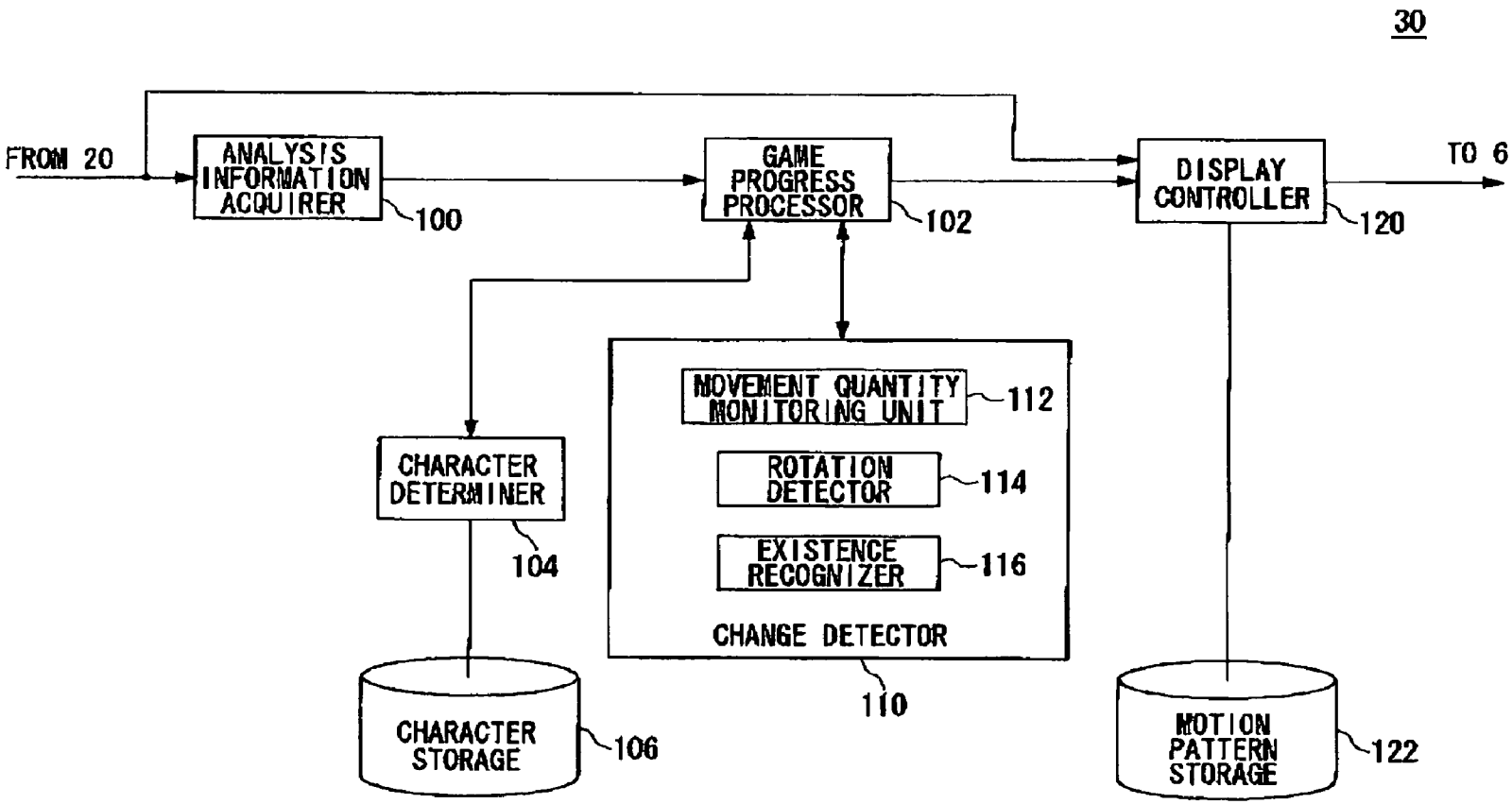
FIG. 4 shows the structure of a game apparatus.

FIG. 4 shows the structure of a game system 30. The game system 30 is provided with an analysis information acquirer 100, a game progress processor 102, a character determiner 104, a character storage 106, a change detector 110, a display controller 120, a motion pattern storage 122. The change detector 110 is provided with a movement quantity monitoring unit 112, a rotation detector 114 and an existence recognizer 116. The change detector 110 detects temporal state change of the real object image captured by the imaging apparatus 2.

Processing function of the game apparatus 30 according to the first embodiment is implemented by a CPU, a memory, a program loaded into the memory, etc. FIG. 4 depicts structure implemented by the cooperation of the elements. The program may be built in the game apparatus 30 or supplied from an external source in the form of a recording medium. Therefore, it will be obvious to those skilled in the art that the functional blocks may be implemented by a variety of manners including hardware only, software only or a combination of both. In the illustrated example, the CPU of the game apparatus 30 has the functions of the analysis information acquirer 100, the game progress processor 102, the character determiner 104, the change detector 110, the display controller 120.

The analysis information acquirer 100 receives an analysis result from the image analysis apparatus 20. This analysis result includes attitude information, orientation information, distance information and identification information on the game card 4, a real object. The analysis information acquirer 100 delivers the received analysis result to the game progress processor 102. The analysis information acquirer 100 may receive frame image data from the imaging apparatus 2 directly. In this case, game apparatus 30 has the functions of image analysis apparatus 20 and performs the same process as described above in relation to the image analysis apparatus 20.

The game progress processor 102 controls the whole process of the game application. In the game application according to the first embodiment, the game progress comprises a plurality of stages and a different game scene is set to each game stage. A player clears the terminating condition of each stage stepwise and the game finishes when he clears the final stage. The game progress processor 102 controls the progress of the game and reports the name of a game stage to be started next and identification information sent from the analysis information acquirer 100 to the character determiner 104 at the time of starting the game or changing stages.

The character storage 106 stores identification information on the game card 4 and three-dimensional image data of a character associated with each other for each stage. Based on the game stage name and identification information, the character determiner 104 reads three-dimensional image data of a character associated with identification information from the character storage 106 and provides the game progress processor 102 with the data. The read three dimensional image data may be provided to the display controller 120 directly. The game progress processor 102 provides the display controller 120 with three-dimensional image data and attitude information, orientation information and distance information on the game card 4. The display controller 120 displays the character on the display 7 in association with the displayed position (displayed region or displayed area) of the game card 4.

More specifically, the display controller 120 receives the frame image sent from the image analysis apparatus 20 and displays it on display 7. The display controller 120 recognizes the attitude, orientation and the distance of the game card 4 from the attitude information, the orientation information and the distance information on the game card 4 and determines the attitude, the orientation and the size of the character to be displayed on a display 7 using three-dimensional image data. For example, the character may be displayed inclined along the normal to the card in case the game card 4 is inclined against the table 3. The display controller 120 may locate the character at any position as far as it is superimposed on the game card 4. The displayed position of the character is set to be above a center of the game card 4 in ordinary display mode. A character may have an inner parameter that represents, for example, emotion or condition depending on the player's operating history.

The motion pattern storage 122 stores a motion pattern of a character in ordinary operating state. More specifically, the motion pattern storage 122 sets a motion pattern associated with a character, a game stage and an inner parameter. Thus, based on the character name, game stage being played and inner parameter of a character, the display controller 120 chooses a motion pattern from the motion pattern storage 122 and controls the character on display 7.

As the player moves the game card 4 slowly, the image analysis apparatus 20 transmits the analysis results of a frame image to the analysis information acquirer 100 successively. Manipulating a game card 4 slowly or not moving the card at all will be referred to as an ordinary manipulating state compared to a state change of a game card 4 described below. The display controller 120 receives three-dimensional image data of a character and the attitude information, the orientation information and the distance information on the game card 4 from the game progress processor 102. The controller makes a character be superimposed on a displayed position of a game card 4 and follow the game card 4. Thus a character is displayed consistently on a game card 4 on the display 7, which makes a player feel a sense of togetherness of a character and a game card 4. As described, the display controller 120 superimposes a character on a game card 4 at an ordinary manipulating state of a game card 4.

In case a game card 4 is set at a predetermined state for imaging through player's manipulation, the display controller 120 does not make a character simply follow the game card 4 but controls the display mode of the character and makes variations in the motion pattern of the character. Player's action on a game card 4 works as a trigger to change the motion pattern of a character, which gives a player a pleasure different from the pleasure derived from an ordinary manipulation using, for example, a game controller. The game progress processor 102 delivers attitude information, orientation information and distance information on the game card 4 to the change detector 110 to detect whether a game card 4 is manipulated in an ordinary manner. The change detector 110 detects a temporal state change in an image of a game card 4 in a frame image.

The movement quantity monitoring unit 112 monitors the quantity of movement of a game card 4 captured by the imaging apparatus 2. More specifically, the movement quantity monitoring unit 112 determines the velocity of the game card 4 based on the central coordinate and distance information included in attitude information on the game card 4. The movement quantity monitoring unit 112 stores the central coordinate and distance information on the game card 4 for each frame in a memory (not shown) and calculates a movement vector using change in distance and a difference in the central coordinate among a predetermined number of frames. Thus, movement velocity is calculated. In case the central coordinate is represented as a three-dimensional coordinate, difference among central coordinate values simply determines a movement vector. The movement quantity monitoring unit 112 monitors the quantity of movement of a game card 4 captured by the imaging apparatus 2. The movement quantity monitoring unit 112 may monitor a quantity of movement in determined virtual space or may monitor an actual quantity of movement.

On determining that the movement velocity of a game card 4 exceeds a predetermined reference speed, the movement quantity monitoring unit 112 reports the results to the game progress processor 102. The movement velocity of a game card 4 may be the movement velocity of the captured game card 4 in virtual space or an actual movement speed. On receiving the determination results, the game progress processor 102 recognizes that the game card 4 is moved quickly by a player. This event is referred to as a "slide event". The game progress processor 102 reports the name of the character and the occurrence of the slide event to the display controller 120. On receiving the report on the occurrence of the slide event, the display controller 120 searches the motion pattern storage 122 for the motion pattern of the character corresponding to the slide event.

The motion pattern storage 122 stores not only the motion pattern in an ordinary manipulating state described above, but also the motion pattern of character at an occurrence of an event. The motion pattern storage 122 defines a motion pattern associated with a name of an event as well as a character, a game stage and an inner parameter. Thus based on the name of the character, the game stage being played now, the inner parameter of the character and the name of the event, the display controller 120 chooses the motion pattern from the motion patter storage 122, displays and controls a character on the display 7.

Being informed of the occurrence of the slide event, the display controller 120 reads the motion pattern which dose not make the character follow the movement of a game card 4 but make the character fall down on the spot from the motion pattern storage 122 and performs it. By moving a game card 4 quickly, a player feels as if the character is not able to follow the movement of the game card 4 and is left behind. Choosing a motion pattern which embodies the feeling and presenting it on the screen of the display 7 allow image processing that fits a player's sense.

Figure 5A:
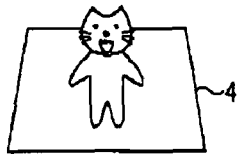
FIG. 5 shows the motion of a character displayed on a display when a slide event occurs.

FIGS. 5A-5D show the motion of the character represented on the display when the slide event occurs. FIG. 5A shows a state wherein the character is superimposed on the game card 4. This state corresponds to an ordinary manipulating state wherein the character is displayed and controlled in accordance with the motion pattern based on, for example, an inner parameter.

Figure 5B:
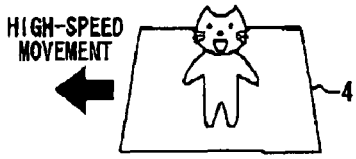

In FIG. 5B, the game card 4 is moved left on the screen by the player. A player's finger manipulating the game card 4 is also displayed on the display 7 (not shown). In case the movement quantity monitoring unit 112 determines that the velocity of the game card 4 exceeds a predetermined reference velocity, the game progress processor 102 reports an occurrence of a slide event to the display controller 120. The display controller 120 makes the game card 4 move left on the display 7 based on a frame image sent periodically from the image analysis apparatus 20.

Figure 5C:
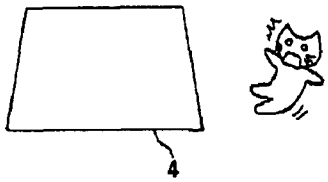

At the time of the detection of the occurrence of the slide event, the display controller 120 does not make the character follow the movement of the game card 4 but make the character fall down as shown in FIG. 5C. I.e., when the slide event occurs, the display controller 120 stops the movement of the character on the spot so that the character is not superimposed on the displayed position of the game card 4. This makes the displayed position of the game card 4 and the displayed position of the character apart momentarily.

Figure 5D:
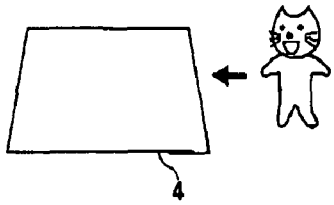
Figure 5E:
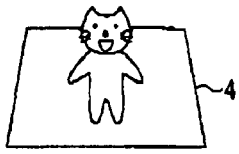

As shown in FIG. 5D, the display controller 120 makes the character get up at a predetermined point of time and move to the displayed position of the game card 4. For example, the action may be timed to occur when the quick movement of the game card 4 is ended or when a predetermined span of time elapsed since the occurrence of the slide event. The display controller 120 plays back the motion of the character moving back to the central coordinate of the game card 4 as a target on the display 7. A series of movement of the character shown in FIGS. 5A-5D are determined by a motion pattern chosen by the display controller 120. FIG. 5 shows the character being back to the displayed position of the game card 4. With the game application according to the first embodiment, a player enjoys the series of movement of the three-dimensional character by moving the game card 4. In the game system 1, the player's attempts to manipulate the game card 4 in various ways induce new movements of the character on the display, which raises the excitement of playing the game application.

The movement quantity monitoring unit 112 monitors not only the movement velocity, but also a moving direction of the game card 4 captured by the imaging apparatus 2. The movement quantity monitoring unit 112 stores the central coordinate of a game card 4 on each frame in a memory (not shown) and calculates a movement vector from difference in central coordinate of a game card 4 among frames. Thus a direction of the movement vector can be detected.

The movement quantity monitoring unit 112 compares a direction of a movement vector with that of another which precedes in time. On detecting a state in which the angle made by movement vectors is substantially 180 degree a plurality of times within a fixed span of time, the movement quantity monitoring unit 112 reports the detected result to the game progress processor 102. Three occurrences of reversal in the direction of the movement vector in two seconds may be set as a condition to report. On receiving the detection results, the game progress processor 102' recognizes that the game card 4 shuttles to and fro. This event is referred to as a "shuttle event". The game progress processor 102 reports the name of a character and the occurrence of the shuttle event to the display controller 120. Being informed of the occurrence of the shuttle event, the display controller 120 searches the motion pattern storage 122 for the motion pattern of the character corresponding to the shuttle event.

Figure 6A:
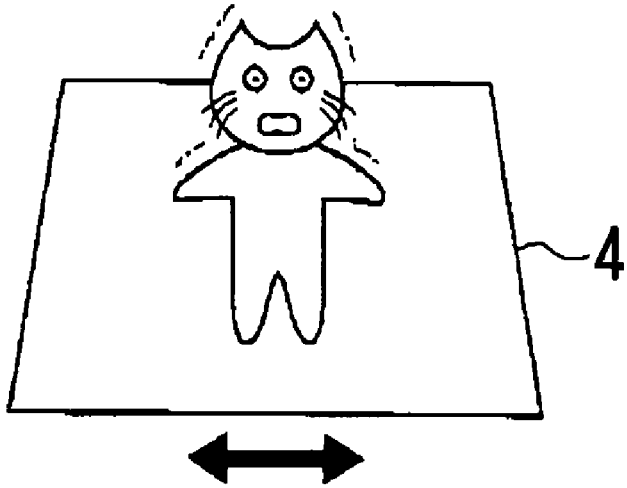
FIG. 6 shows the motion of a character rendered on a display when a shuttle event occurs.
Figure 6B:
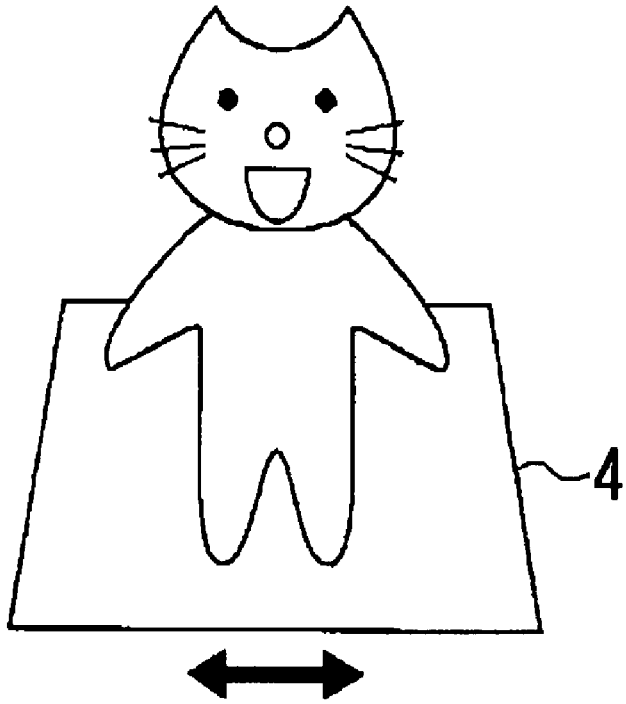

FIG. 6A-6C show a motion of the character represented on the display when the shuttle event occurs. FIG. 6A shows a state wherein a player scolds the character by shuttling the game card 4 to and fro. When the movement quantity monitoring unit 112 determines that the game card 4 is moved to and fro such that a predetermined condition is fulfilled, the game progress processor 102 reports the occurrence of the shuttle event to the display controller 120. The display controller 120 displays the shuttling movement of the game card 4 and changes motion patterns of the character based on the motion pattern retrieved from the motion pattern storage 122. In this example, the shuttling movement of the game card 4 works as a trigger to perform the motion pattern wherein the character is scolded. And the character shows a shocked expression because of being scolded. During the shuttling movement of the game card 4, the character may not follow the shuttling movement of the game card 4 but the displayed position of the character may be fixed as far as it is within the movement range of the game card 4. In case the amplitude of the shuttling movement is large enough to leave the character apart from the game card 4, it is favorable to make the character follow the game card 4.

FIG. 6B shows a character having grown huge by shuttling a game card 4 to and fro. In this way, the motion pattern storage 122 may store a plurality of motion patterns in correspondence with a shuttling movement of a game card 4. The motion pattern storage 122 may store a motion pattern in relation with a game stage and may further store a motion pattern in relation with an inner parameter of a character as described above.

Referring back to FIG. 4, the rotation detector 114 detects a rotating movement of a game card 4. More specifically, the rotation detector 114 detects a rotating movement of a game card 4 based on a center coordinate and orientation information included in attitude information on a game card 4. The rotation detector 114 stores center coordinate and attitude information on a game card 4 for each frame in a memory (not shown). In case the orientation of a game card 4 defined by orientation information changes with respect to time on a substantial plane and the center coordinate of a game card 4 does not shift during the changing of orientation, the rotation detector 114 determines that the game card 4 is rotated. A condition to detect rotation may be that the orientation of a game card 4 is changed more than 360 degree to the same rotational direction.

On determining that a game card 4 is rotating, the rotation detector 114 reports the judgment to the game progress processor 102. On receiving the determination results, the game progress processor 102 recognizes that the game card 4 is being rotated. This event is referred to as a "rotation event". The game progress processor 102 reports the name of a character and the occurrence of the rotation event to the display controller 120. On receiving information on the occurrence of the rotation event, the display controller 120 searches for a motion pattern corresponding to the rotation event defined for the character.

The display controller 120 chooses a motion pattern defined for a character in the game stage being played. Using the chosen motion pattern, the display controller 120 changes motion patterns of a character. More specifically, the display controller 120 reads and performs a motion pattern in which a character feeling dizzy.

Figure 7:
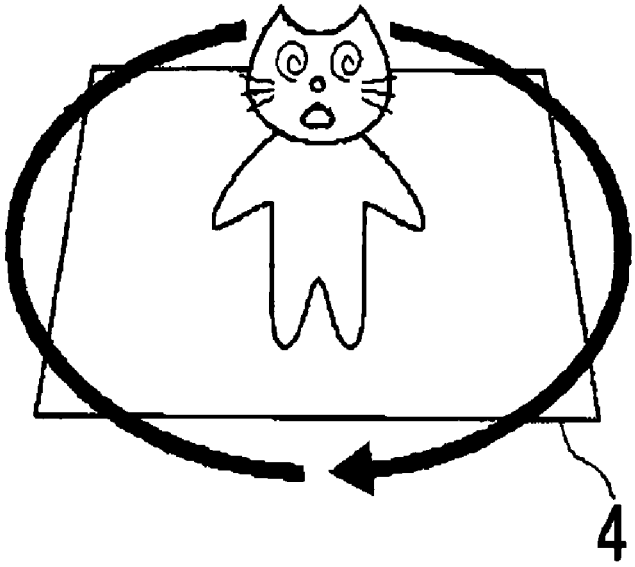
FIG. 7 shows a state in which a character feeling dizzy.

FIG. 7 shows a state in which a character feels faint by a rotary motion of a game card. The state in which a character feels faint returns to an ordinary state after a lapse of predefined time. It is easy to grasp through intuition that the rotary motion of the game card 4 makes a character feel dizzy. It is favorable that the motion pattern of a character corresponding to the manipulation of a card link to the manipulation of the card itself since a game controller is not used in the first embodiment. In this way, associating a manipulation of a card and a motion pattern of a character with each other enables a player to manipulate easily. Determining a three-dimensional character's motion pattern by a manipulation of a card makes it possible to realize a new game application, which gives a player a new experience and sensation.

Referring back to a FIG. 4, the existence recognizer 116 checks whether a game card 4 exists within the imaging field 5. Existence of a game card 4 within the imaging field 5 is determined by whether information on a game card 4 is analyzed in the image analysis apparatus 20. In case a game card 4 is hidden by a player the image analysis apparatus 20 is not able to recognize an image of a game card 4, thus image analysis results of a game card 4 is not sent to the game apparatus 30.

In case a real object is not recognized in a series of predefined number of frame images, the existence recognizer 116 determines that a real object is not captured by the imaging apparatus 2. Conversely, in case a number of consecutive frame images in which a real object is not recognized is less than predefined number, the existence recognizer 116 determines the real object is captured by the imaging apparatus 2. A real object not being recognized in a predefined numbers of consecutive frame images is set as the condition since it is necessary to neglect a frame in which a game card 4 is not detected by chance, for example, by an influence of a lighting.

On determining that a game card 4 is not captured, the existence recognizer 116 reports the determination results to the game progress processor 102. On receiving the determination results, the game progress processor 102 recognizes that a game card 4 does not exist in an imaging field 5. This event is referred to as a "hiding event". The game progress processor 102 reports a name of a character and an occurrence of the hiding event to the display controller 120. A player can generate a hiding event by, for example, hiding a game card 4 by his hand or moving a game card 4 out of the imaging field 5. On receiving information on an occurrence of the hiding event, the display controller 120 searches the motion pattern storage 122 for the motion pattern corresponding to the hiding event set for the character.

In this case, the display controller 120 makes the character disappear from a screen of the display 7 using the chosen motion pattern. This motion pattern is also easy to understand for a player. Thus, a player is able to manipulate a character with intuition without understanding how to play the game sufficiently.

The existence recognizer 116 may determine that a state change between a state wherein a game card 4 is captured and a state wherein a game card 4 is not captured is repeated. A player can disable imaging of a game card 4 by holding his hand over the game card 4. And moving out his hand enables imaging a game card 4. If a switching between a captured and not captured state is repeated predefined times in predefined time span, the existence recognizer 116 detects the change in image capturing state and reports the detected results to the game progressing processor 102. On receiving the determination results, the game progress processor 102 recognizes that switching between a state where a game card 4 is captured and a state where a game card 4 is not captured by the imaging apparatus 2 occurs. This event is referred to as a "switching event". The game progress processor 102 reports the name of a character and an occurrence of the switching event to the display controller 120. On receiving information on the occurrence of the switching event, the display controller 120 searches the motion pattern storage 122 for a motion pattern of the character corresponding to the switching event.

In this case, the display controller 120 displays a new virtual object on display 7 using the chosen motion pattern.

This new object is not displayed in an ordinary manipulating state. An occurrence of the switching event works as a trigger to display the entirety of the virtual object newly. This is an appearance of, so to say, a hidden character in the game industry. An appearance of a new character makes it possible to bring a change to game progression.

With the game system 1, a player does not have to remember a motion pattern allotted to a manipulation of a card necessarily. A player may manipulate a game card 4 in variety of ways and try to move a character. The game application according to the first embodiment provides a player a new way to enjoy a game.

Figure 8:
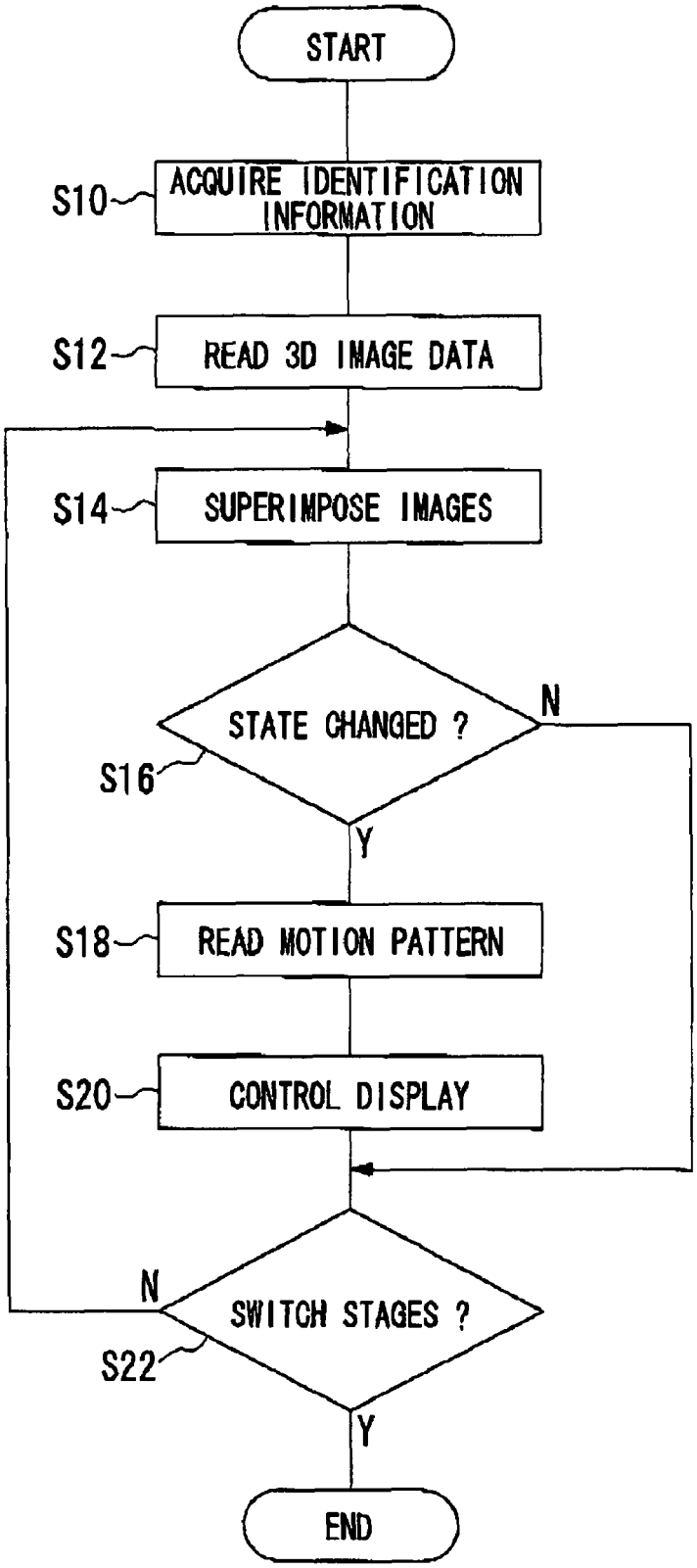
FIG. 8 is a flowchart of an image analysis.

FIG. 8 shows a flowchart for an image processing according to the first embodiment. In the game apparatus 30, the analysis information acquirer 100 acquires identification information on a game card 4 from the image analysis apparatus 20 (S10). On receiving identification information, the character determiner 104 reads three-dimensional image data of the character corresponding to identification information and the stage being played from the character storage 106. The display controller 120 superimposes the read three-dimensional image data of the character on the displayed position of the game card 4 on the display 7.

The change detector 110 monitors a state change of a game card 4 with respect to time (S16). On detecting a predefined state change (Y in S16), the display controller 120 reads a motion pattern corresponding to the state change from the motion pattern storage 122 (S18), displays and controls a character according to the motion pattern (S20). If the stage continues (N in S22), the display controller 120 returns character's display mode to the ordinary state and superimposes the character on the game card 4. If a predefined state change is not detected (N in S16) and there is not a switching between stages, a superposing display mode is maintained. In case stages are changed (Y in S22), the present flow ends. When a subsequent stage begins, three-dimensional image data of a character corresponding to the stage is read out and the flow described above is performed.

The first embodiment is explained above. This embodiment is only illustrative in nature and it will be obvious to those skilled in the art that variations in constituting elements and processes are possible and that those variations are within the scope of the present invention. While an example in which a motion pattern of a character is changed is explained according to the first embodiment, it is also possible, for example, to present additional virtual object other than the main character and the new virtual object moved in the opposite direction so that it goes apart from the main character when displayed.

As an example of variations, the display controller 120 may display another virtual object together with a character and detection of a state change of the game card 4 by the change detector 110 may work as a trigger to move the virtual object in the direction determined by the orientation determiner 54 in the image analysis apparatus 20, so that the virtual object moves apart from the character. Another virtual object may be an item used for game progress (e.g., a virtual object like a ball thrown by a character).

Figure 9A:
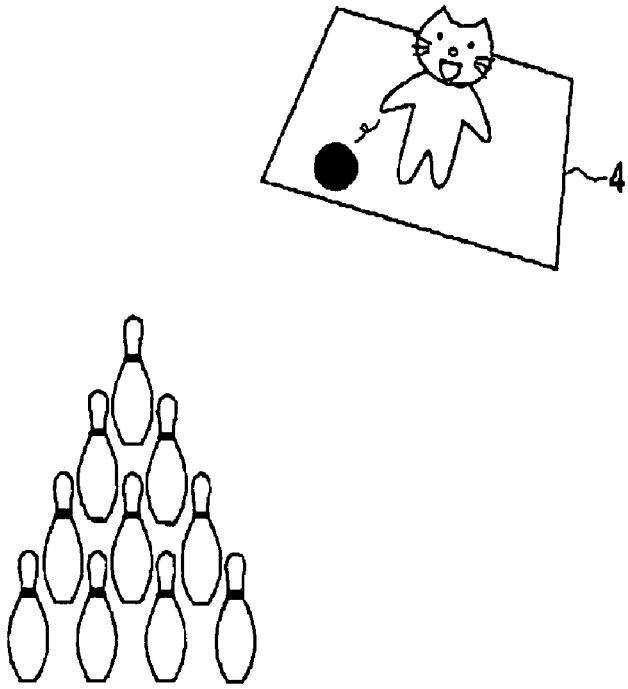
FIGS. 9A and 9B show exemplary displays where a character plays bowls.

FIG. 9A shows an exemplary displaying in which a character throws a ball and plays bowls. As described above, the orientation determiner 54 determines the orientation of a game card 4, based on the position of the orientation indicator 11 on the game card 4 in real space. In case a displayed position of virtual bowling pins on the display 7 is fixed, a player moves the game card 4 and adjusts position and direction for the character to throws the ball, while watching the display 7. Bowling pins may be virtual objects displayed on another game card 4. The character determiner 104 reads three-dimensional image data of the ball from the character storage 106 and provides it to the game progress processor 102 on condition bowling pins are displayed on the other game card 4. The display controller 120 receives three-dimensional image data of the ball from the game progress processor 102 and controls the character to hold the ball when displayed. When the character is displayed at a desired position as the player moves the card, the player manipulates the game card 4 and generates an event that is set as a trigger to throw the ball. It is favorable that this event be announced to the player on the screen or through a speaker. On receiving information on occurrence of the event, the display controller 120 rolls the ball in the direction determined by the orientation determiner 45 and calculates the number of bowling pins which fall down based on the direction by a predetermined computation. In this case, the display controller 120 unifies coordinates of bowling pins and the character into the same coordinate system and determines whether the ball, as moving object, and bowling pins make contact, which makes this displaying process possible. Playing bowls is given as one example above. Launching a virtual object from a character allows developing a new game story using an object other than a character.

While the orientation determiner 54 may determine the direction using the direction indicator 11 printed on the game card 4, in case the game card 4 is inclined, it may adopt a vector along a slope as the direction of the game card 4.

Figure 9B:
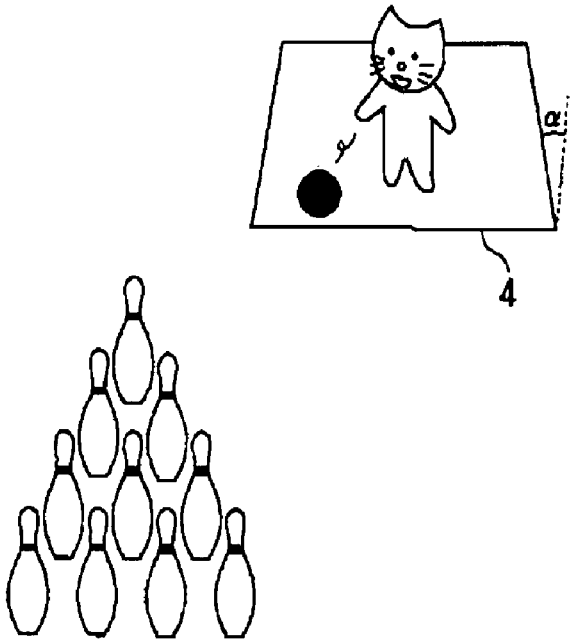

FIG. 9B shows another exemplary display in which a character throws a ball and plays bowls. The orientation determiner 54 determines a direction in which the game card 4 is inclined in real space. This direction of inclination is defined as a direction on the table 3 perpendicular to the side of the game card 4 that makes contact with the table 3. Differing from an example of FIG. 9A, in this case, direction to throw the ball is determined based on a line where the game card 4 and the table 3 make contact with each other. The player places the game card 4 at a desired position and makes it inclined. In this process, setting the game card 4 inclined may be set as a trigger to throw a ball. Detecting from attitude information that the game card 4 is inclined, the game progress processor 102 reports it to the display controller 120. The display controller 120 reads out a motion pattern and rolls the ball in the direction determined by the orientation determiner 54.

In the first embodiment and an example of variation described above, display mode of the character is controlled based on a state change of the game card 4. To make the game application more interesting and exciting, not only a display mode of the character but also, for example, voice may be used for presentation effect. In this case, when a state change of the game card 4 is detected, by the change detector 110, the game progress processor 102 may reports to a voice controller (not shown), and the voice controller may direct an auditory presentation effect of the character through the speaker. In this case the game apparatus 30 functions not only as an image processing apparatus but also as a voice processing apparatus. Thus the game apparatus 30 may be referred to as a processor which is able to control both image and voice. The game apparatus 30 may control only voice depending on a state change of the game card 4.

Second Embodiment

The second embodiment of the present invention provides a technique for detecting a positional relation among a plurality of real object images captured by the imaging apparatus and controlling a display mode of a virtual object based on the detected relation. A real object may be a one-dimensional object, a two-dimensional object or a three-dimensional object. It is favorable that a real object be provided with a distinctive part that identifies the real object. For example, a real object may be a two-dimensional object, such as a card that is provided with two-dimensionally represented coded information as a distinctive part, or a three-dimensional object with a uniquely shaped three-dimensional part as a distinctive part. A two-dimensional shape of a two-dimensional object may constitute a unique distinctive part or distinctive coded information may be affixed on a three-dimensional object. A virtual object may be, so to say, a character, such as a person, an animal or material goods that is represented three-dimensionally in virtual space. The second embodiment described below relates to an image processing technology in a game application and adopts a game character presented in a game application as a virtual object. The second embodiment depicts a game application in which the player's manipulation for making real objects contact with each other leads to an occurrence of an event corresponding to the contact and performing an event one by one makes the game progress.

Figure 10:
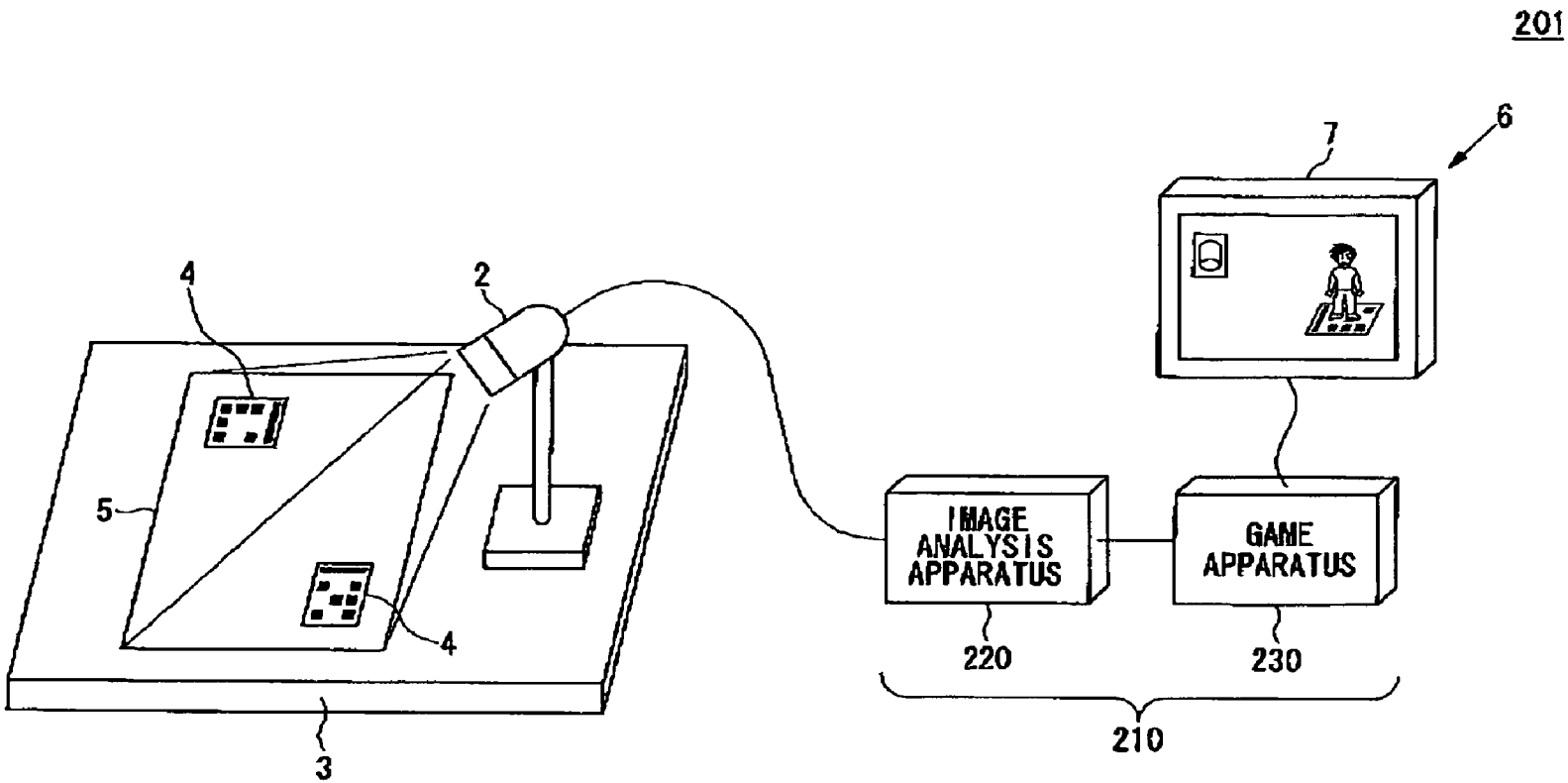
FIG. 10 shows the structure of a game system according to another exemplary embodiment.

FIG. 10 shows the structure of a game system 201 according to the second embodiment. The game system 201 is provided with an imaging apparatus 2, an image processing apparatus 210 and an output apparatus 6. The image processing apparatus 210 is provided with an image analysis apparatus 220 and a game apparatus 230. The image analysis apparatus 220 and the game apparatus 230 may be separate apparatuses or may be integrally combined. The imaging apparatus 2 is embodied by a video camera comprising a charge coupled device (CCD) imaging element, a metal oxide semiconductor (MOS) imaging element or the like. The imaging apparatus 2 captures an image of real space periodically so as to generate a frame image in each period. An imaging area 5 represents a range captured by the imaging apparatus 2. The position and size of the imaging area 5 are adjusted by adjusting the height and orientation of the imaging apparatus 2. A game player manipulates a game card 4, a real object, in the imaging area 5. The game card 4 is provided with a distinctive part that uniquely identifies the card.

The output apparatus 6 is provided with a display 7. The output apparatus 6 may also be provided with a speaker (not shown). The image processing apparatus 210 causes the display 7 to display a frame image captured by the imaging apparatus 2. In this process, the image processing apparatus 210 controls a character, a virtual object, to be superimposed on the game card 4 when displayed. In the illustrated example of FIG. 10, two game cards exist in the imaging area 5 and characters are superimposed on each game card 4 on display 7. The player can easily recognize whether the game card 4 is located within the imaging area 5 by watching the display 7. If the game card 4 is not located within the imaging area 5, the player may allow the imaging apparatus 2 to capture the image of the game card 4 by shifting the position of the game card 4 or by adjusting the orientation of the imaging apparatus 2.

In the game application according to the second embodiment, the player moves a character by manipulating the game card 4. As called for by the nature of the game application, it is favorable that the player feel the sense of unity between the game card 4 and the character. For this purpose, the image of the character is superimposed on the game card 4.

The character's motion is controlled by the image processing apparatus 210. First, the image analysis apparatus 220 extracts image information for the game card 4 from the frame image captured by the imaging apparatus 2. The image analysis apparatus 220 further extracts the unique distinctive part to identify the game card 4 from image information on the game card 4. In this process, the image analysis apparatus 220 determines position information, orientation information and distance information on the game card 4 in space, by referring to image information on the game card 4. As described above in FIG. 2, an orientation indicator 11 and an identification indicator 12 are printed on a surface of a game card 4.

As described in regard to FIG. 2, The orientation indicator 11 is provided to indicate the front side of the game card 4 and the identification indicator 12 is provided to represent a distinctive field to identify the card uniquely. An identification indicator 12 is coded information made by a plurality of blocks printed on a predetermined field. Of the plurality of blocks, four corner blocks are given to a plurality of game cards 4 commonly. Thus actually, a distinctive part is comprised of blocks other than the four corner blocks. The four corner blocks are used to measure a distance from an imaging apparatus 2.

Referring back to FIG. 10, the image processing apparatus 220 determines the distance between the imaging apparatus 2 and the game card 4 from the length between the four corner blocks in the image of the game card 4 identified in the frame image. The image processing apparatus 220 further determines the orientation of the game card 4 by using the orientation indicator 11. In this case, the orientation indicator defines the front side and the character is controlled so that the character faces forward when displayed on the game card 4. The image analysis apparatus 220 also acquires identification information on the game card 4 by referring to an array of blocks other than the four corner blocks.

The result of image analysis by the image analysis apparatus 220 is sent to the game apparatus 230. The frame image captured by the imaging apparatus 2 may be sent to the game apparatus 230 and the game apparatus 30 may analyze the image. In this case, the image processing apparatus 210 may be formed only of the game apparatus 230.

The game apparatus 230 controls the character to be displayed on the game card 4 on the screen of the display 7 based on the result of image analysis by the image analysis apparatus 220. A character may be assigned to each game scene for a game card 4 as appropriate. In this case, when game scenes are switched, displayed characters are also changed. In the second embodiment, the game apparatus 230 detects a positional relation among a plurality of real object images. On judging that the positional relation among a plurality of real object images fulfills a predefined condition, the game apparatus 230 controls the display mode of the character.

Figure 11:
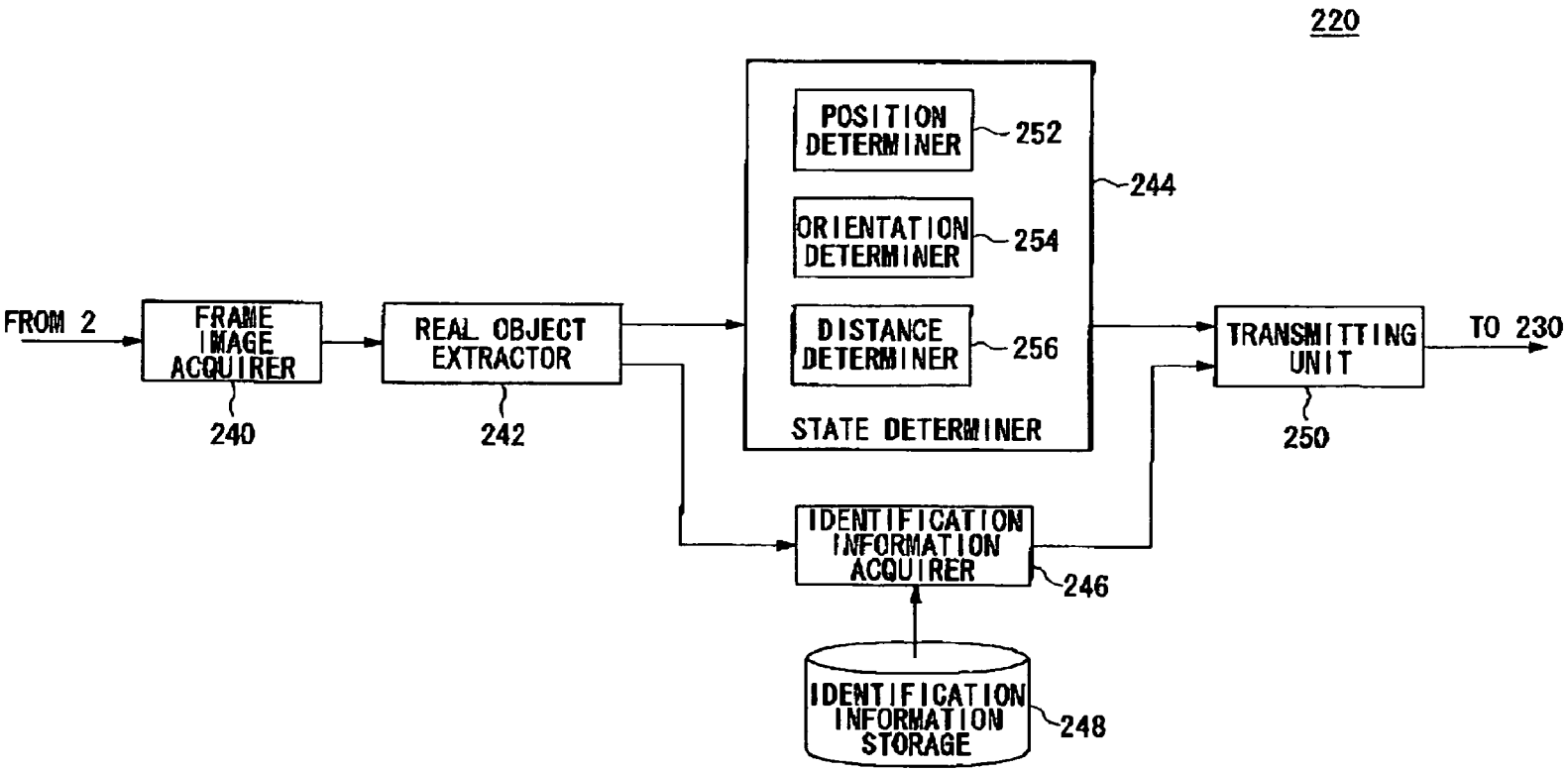
FIG. 11 shows the structure of a image analysis apparatus.

FIG. 11 shows the structure of the image analysis apparatus 220. The image analysis apparatus 220 is provided with a frame image acquirer 240, a real object extractor 242, a state determiner 244, identification information acquirer 246, identification information storage 248 and a transmitting unit 250. The identification information storage 248 stores information on the distinctive field for identifying the real object and identification information for identifying the real object with each other. To be more specific, the identification information storage 48 stores pattern information on the identification indicator 12 and identification information in a one-to-one relationship. Identification information is used to allot a character in the game apparatus 230. For example, in case of the game system 201 which allows using five game cards 4 simultaneously, number 1 to 5 may be allotted to respective game card 4 as identification information. Relating respective game card 4 to identification information allows recognizing each game card 4. The state determiner 244 determines the state of the real object in the defined coordinate system. More specifically, the state determiner 244 is provided with an attitude determiner 252 which determines the attitude of a card, an orientation determiner 254 which determines the orientation of a card and a distance determiner 256 which determines the focal distance from the imaging apparatus 2.

The frame image acquirer 240 acquires a frame image of real space captured by the imaging apparatus 2. It is given that a plurality of game cards are placed in the imaging area 5 here, as shown in FIG. 10. The imaging apparatus 2 captures a frame image at regular intervals. Preferably, the imaging apparatus 2 generates frame images at intervals of 1/60 second.

The real object extractor 242 extracts a plurality of real object images, i.e., a plurality of game card 4 images, from the frame image. This process is performed by translating image information into a binary bit representation and extracting the image of the game card 4 from the binary bit representation (i.e. dot processing). Extracting an image may be performed by detecting ons and offs of a bit. This process may also be performed by a known image matching technology. In this case, the real object extractor 242 registers image information on a real object to be used in a memory (not shown) in advance. Matching registered image information and captured image information allows cutting out images of multiple game cards 4 from the frame image.

The state determiner 244 detects geometry information of the table 3 on which the game card 4 is placed and moved beforehand. The state determiner 244 further defines the surface of the table 3 as a reference plane and records geometry information on the attitude of the game card 4 placed on the reference plane as the initial attitude of the game card 4. This geometry information may be formed with reference to the imaging apparatus 2. The state determiner 44 maintains the position, the attitude and the like of the table 3 as coordinate data in imaging space from the geometry information acquired of table 3. The position determiner 252 determines the position of the real object image. More specifically, the position determiner 252 determines coordinates of the center point of the real object image in the frame image. In addition to the position of the game card 4, the attitude determiner 252 may determine the inclination and height of the game card 4 with respect to the reference plane as a difference in relative quantity of state from the attitude of the game card 4 recorded as the initial state (i.e., difference of coordinate values in imaging space). The orientation determiner 254 determines the orientation of the real object image. The orientation determiner 254 may detect the orientation indicator 11 shown in FIG. 2 from the real object image and determine the orientation of the real object. The distance determiner 256 determines the distance between the imaging apparatus 2 and the game card 4 from the length among the four corners of identification indicator 12 in the game card 4 image. The identification information acquirer 246 extracts a distinctive feature from the real object image and acquires corresponding identification information from identification information storage 248.

Position information, orientation information and distance information determined by the state determiner 244 and identification information acquired by the identification acquirer 246 are associated with each other and transmitted to the game apparatus 30 from the transmitting unit 250. Associating is performed for each game card 4. To display the frame image captured by the imaging apparatus 2 on the display 7, the frame image itself is also transmitted to the game apparatus 230 from the transmitting unit 250.

Figure 12:
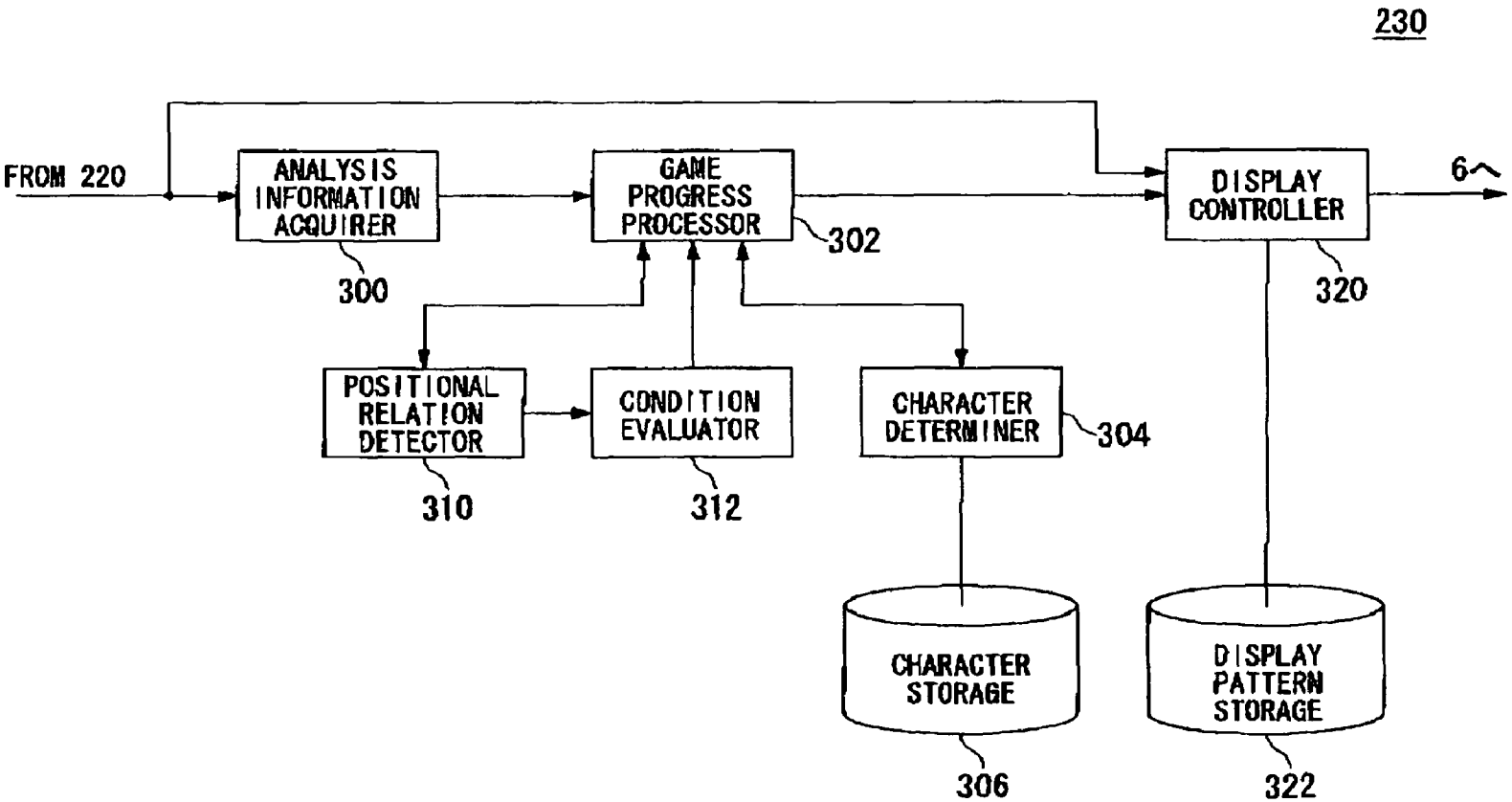
FIG. 12 shows the structure of a game apparatus.

FIG. 12 shows the structure of the game system 230. The game system 230 is provided with the analysis information acquirer 300, a game progress processor 302, a character determiner 304, a character storage 306, a positional relation detector 310, a condition evaluator 312, a display controller 320 and a display pattern storage 322.

Processing functions of the game apparatus 230 according to the second embodiment are implemented by a CPU, a memory, a program loaded into the memory, etc. FIG. 12 depicts function blocks implemented by the cooperation of the elements. The program may be built in the game apparatus 230 or supplied from an external source in the form of a recording medium. Therefore, it will be obvious to those skilled in the art that the functional blocks may be implemented by a variety of manners including hardware only, software only or a combination of both. In the illustrated example, the CPU of the game apparatus 230 has the functions of the analysis information acquirer 300, the game progress processor 302, the character determiner 304, the positional relation detector 310, the condition evaluator 312, a display controller 320.

The analysis information acquirer 300 receives an analysis result from the image analysis apparatus 320. This analysis result includes position information, orientation information, distance information and identification information on the game card 4, a real object. The analysis information acquirer 300 delivers the received analysis result to the game progress processor 302. The analysis information acquirer 300 may receive frame image data from the imaging apparatus 2 directly. In this case, the game apparatus 230 has the functions of image analysis apparatus 220 and perform the same process as described above in relation to the image analysis apparatus 220.

The game progress processor 302 controls the whole process of the game application. In the game application according to the second embodiment, the game progress comprises a plurality of stages and a different game scene is set to each game stage. A player clears the terminating condition of each stage stepwise and the game finishes when he clears the final stage. The game progress processor 302 controls the progress of the game and reports the name of a game stage to be started next and identification information sent from analysis information acquirer 300 to the character determiner 304 at the time of starting the game or changing stages. The character storage 306 stores identification information of the game card 4 and the three-dimensional data of a character associated with each other for each stage.

FIG. 13 shows the contents stored in the character storage 306. The game system 201 according to the second embodiment allows five game cards 4 to be used. The character storage 306 stores three-dimensional data of a character corresponding to each of five game cards 4 in relation with a game stage. At stage 1, a character "a man", a character "a woman", a character "a drum", a character "a restaurant building" and a character "a post office building" are allotted to the game card of identification information 1, the game card of identification information 2, the game card of identification information 3, the game card of identification information 4 and the game card of identification information 5, respectively. At stage 2, a character "a man", a character "a woman", a character "a door of a restaurant", a character "a waiter" and a character "a table and chairs" are allotted to the game card of identification information 1, the game card of identification information 2, the game card of identification information 3, the game card of identification information 4 and the game card of identification information 5, respectively. Characters allotted to identification information 3, 4 and 5 are different between stage 1 and stage 2.

Based on the name of a game stage and a plurality of pieces of identification information, the character determiner 304 reads three-dimensional image data of a plurality of characters associated with identification information and provides the game progress processor 302 with data. The read three dimensional image data may be provided to the display controller 320 directly. The game progress processor 302 provides the display controller 320 with three-dimensional image data and position information, orientation information and distance information on the game cards 4. The display controller 320 displays a character on the display 7 in association with the displayed position of the game card.

More specifically, the display controller 320 receives the frame image sent from the image analysis apparatus 220 and displays it on the display 7. The display controller 320 recognizes the position, orientation and the distance of the game card 4 from position information, orientation information and distance information on the game card 4 and determines the position, the orientation and the size of the character to be displayed on the display 7 using three-dimensional image data. The display controller 320 may locate the character at any position as far as it is superimposed on the game card 4. However, in ordinary display mode, the displayed position of the character is set to be above a center of the game card 4.

As a player moves a game card 4, the analysis result of a frame image is sent from the image analysis apparatus 220 to the analysis information acquirer 300 successively. The display controller 320 receives three-dimensional image data of a character and position information, orientation information and distance information on the game card 4 from the game progress processor 302 and makes a character follow the game card 4 so that the image of the character is superimposed on a displayed position of the game card 4. Thus a character is displayed consistently on the game card 4 on the display 7, which makes a player feel a sense of unity between the game card 4 and the character.

Figure 14:
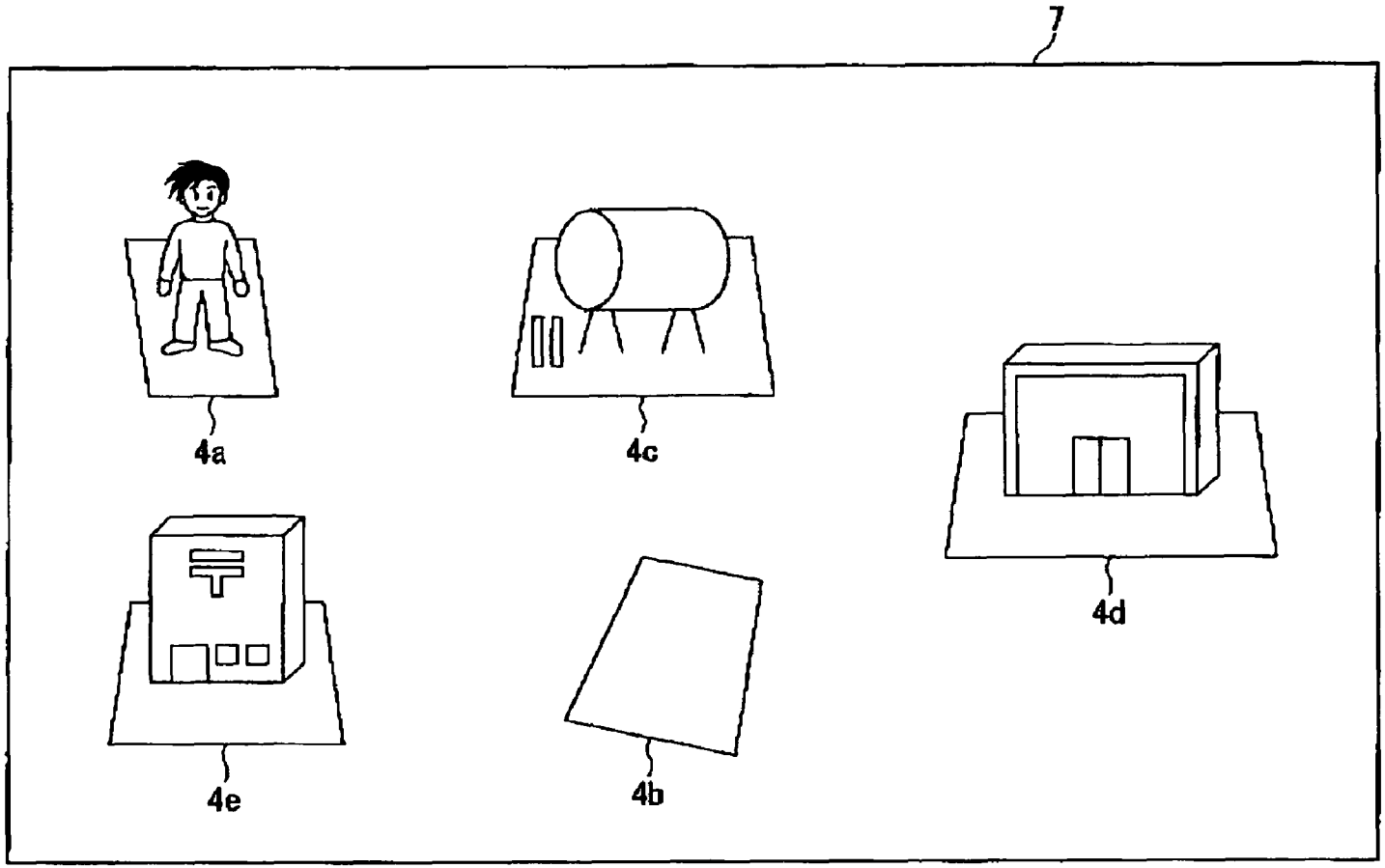
FIG. 14 shows an exemplary displaying on a display in stage 1.

FIG. 14 shows an example of displaying on the display in the stage 1. In this case, a game card 4*a*, a game card 4*b*, a game card 4*c*, a game card 4*d* and a game card 4*e* indicate the game card of identification information 1, the game card of identification information 2, the game card of identification information 3, the game card of identification information 4 and the game card of identification information 5, respectively.

A character "man", a character "a drum", a character "a restaurant building" and a character "a post office building" are superimposed on the game card 4*a*, the game card 4*c*, the game card 4*d* and the game card 4*e* respectively. On the game card 4*c* sticks for striking a drum are also displayed with the drum. In this process, A woman is not yet displayed on the game card 4B.

In the game application according to the second embodiment, an event is generated when an arranged position of a plurality of game cards 4 conforms to a predefined positional relation. By performing the event, game story progresses. The Player's manipulation on a plurality of game cards 4 allows changing, for example, a motion pattern of a character, which gives a player a pleasure different from that derived from ordinary manipulation using a game controller or the like. In illustrated example of FIG. 14, the character "woman" appears on the game card 4*b* by performing a predefined event in stage 1.

A positional relation detector 310 detects a positional relation among images of a plurality of game card 4 images included in a frame image captured by the imaging apparatus 2. More specifically, the game progress processor 302 delivers positional information, orientation information and distance information on a plurality of game cards 4 to the positional relation detector 310 in the first place. The positional relation detector 310 detects position relation among game cards based on position information and distance information on a plurality of game cards 4. In this case, it is favorable to detect positional relations among game cards for all the combinations of no less than two game cards 4. For example, the positional relation detector 310 may compute distance between central coordinates based on the central coordinate of each game card 4.

Based on the positional relation detected by the positional relation detector 310, the condition evaluator 312 determines whether the positional relation among game cards 4 fulfills a predefined condition. In this case, whether a detected positional relation among no less than two game card 4 images fulfills the predefined condition is determined. As an example of condition determination, the condition evaluator 312 determines whether images of game card 4 are in contact with each other. The condition evaluator 312 may determine a contact between game card images simply if a distance between central coordinates of two game card images are within a predefined range.

In determining a contact between game card images, the condition evaluator 312 takes orientations of game card images into consideration. Arrangement of game card images in space is determined, based on central coordinates and orientation of game card images. This enables the condition evaluator 312 to learn the arrangement of game card images in space and determine whether they have contact with each other. In this process, the condition evaluator 312 can also learn on which side of game card images they have contact with each other by taking the orientation into consideration. Since the orientation of game card images is determined by the orientation determiner 254, the condition evaluator 312 can determine which side of a rectangular game card has contact, front side or left side, based on determined orientation information. Since the condition evaluator 312 recognizes the orientation of game card images when judging contact, it is possible to generate a different event, depending on orientation of game cards that have contact. On determining that game card images have contact with each other, the condition evaluator 312 reports determination results, identification information on contacting game card images and orientation of game card image to the game progress processor 302. The game progress processor 302 transfers the information to the display controller 320. The processing of the positional relation detector 310 and the condition evaluator 312 described above may be performed simultaneously.

Furthermore, the condition evaluator 312 may define a virtual viewing angle to, for example, one game card image, and may determine whether another game card image exists in the viewing angle. This determination on condition is performed based on the positional relation detected by the positional relation detector 310, and is used for confirmation on whether another character exists within the viewing angle of the character in the game. In determining that another game card image exists within the viewing angle, the condition evaluator 312 reports determination results, identification information on the game card image on which a viewing angle is defined and identification of a game card image which exists within the viewing angle to the game progress processor 302. This information is transferred to the display controller 320.

In case the condition evaluator 312 determines that the predefined condition is fulfilled, the display controller 320 determines the display pattern of the character based on identification information on no less than two game card images which fulfill the condition. The display controller 320 receives determination results sent from the game progress processor 302, identification information on game card images which fulfill the condition and orientation of game card images, refers to the display pattern storage 322 and determines the display pattern.

The display pattern storage 322 stores the motion pattern of a virtual object. The motion pattern may be, for example, a motion pattern among characters corresponding to identification information on no less than two game card images which fulfill condition. This motion pattern is stored in relation with identification information on no less than two game card images and orientation of those game card images. More specifically, when for example, the game card 4*a* with identification information 1 and the game card 4*c* with identification information 3 come into contact with each other on their front sides, the display controller 320 is able to read a predefined motion pattern from the display pattern storage 322. I.e., that the image of the game card 4*b* and the image of the game card 4*c* are in contact and that they have contact on their front sides is defined as a condition for reading the display pattern from the display pattern storage 322. Thus, in case a game card 4*a* and a game card 4*c* are in contact on the front side and the left side respectively, the display controller 320 is not able to read a motion pattern.

The display controller 320 performs display process of a character on the frame image sent from the image analysis apparatus 220, using three-dimensional image data of a plurality of characters according to the determined motion pattern.

Figure 15:
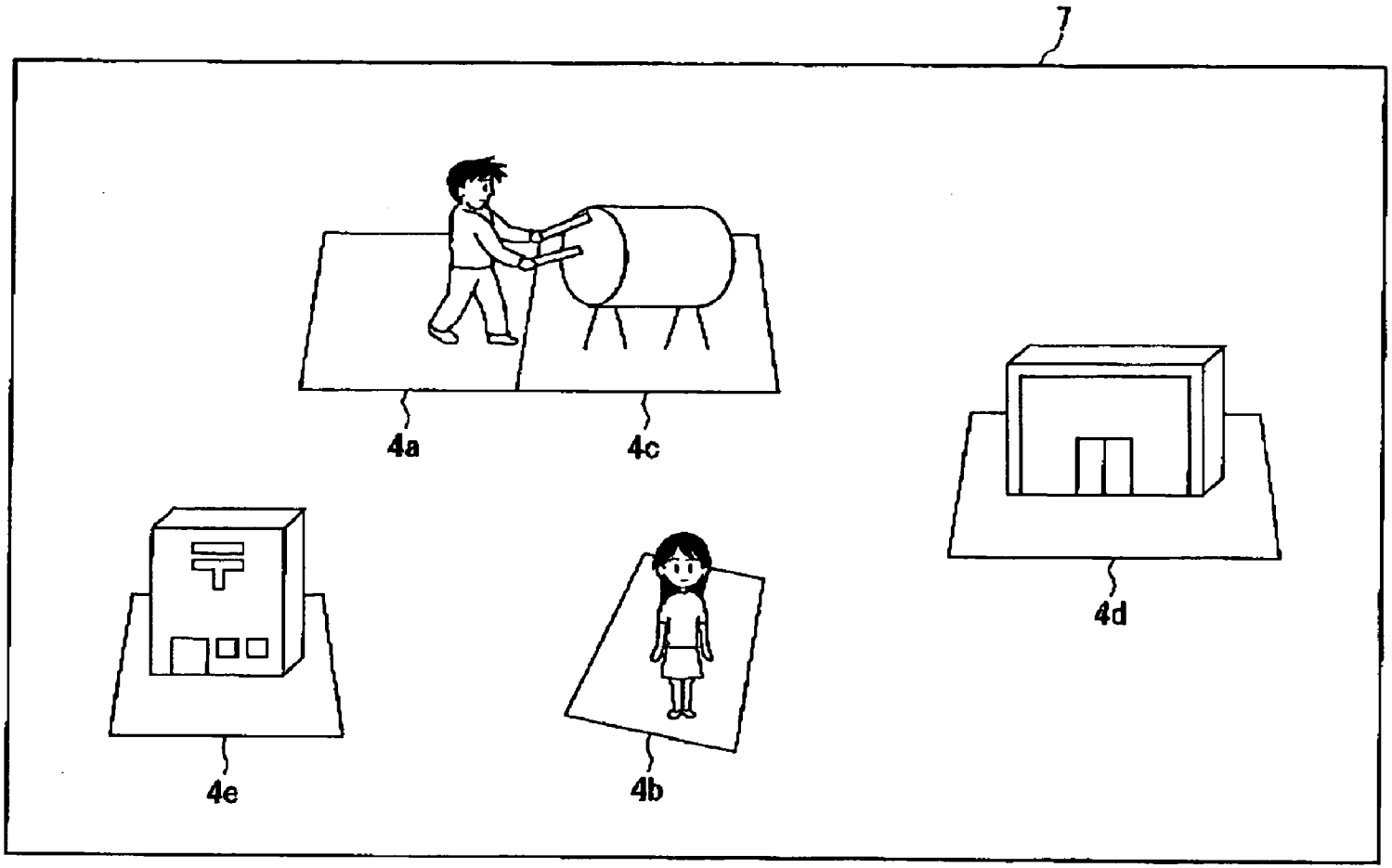
FIG. 15 shows the state which follows the state shown in FIG. 14 and in which two cards come into contact with each other.

FIG. 15 shows the state which follows the state shown in FIG. 14 and in which two cards are placed so that they are in contact with each other. In this case, a game card 4*b* and a game card 4*c* are in contact with each other. The game card 4*a* and the game card 4*c* are in contact on their front sides. Since the man faces forward on the game card 4*a* and the drum is set facing the forward on a game card 4*c*, the man is able to strike the drum. Conversely, the man is not able to strike the drum when he stands left or right side of the drum. Identification information on game cards 4 which are in contact and orientation at the time of contacting are defined as a condition for reading a motion pattern from the display pattern storage 322, as described above. Thus by contacting front sides of game cards, the display controller 320 reads out a predefined motion pattern and performs display process in which the man takes sticks which are put on the game card 4*c* and strikes the drum. This series of motion is determined by a display pattern which is read out.

In this game application the motion of striking the drum is set as the condition to present the character, woman. On recognizing that the drum is struck by the man, the game progress processor 302 presents the woman on the game card 4*b*. Subsequently, the player moves the characters man and woman in front of the restaurant.

Figure 16:
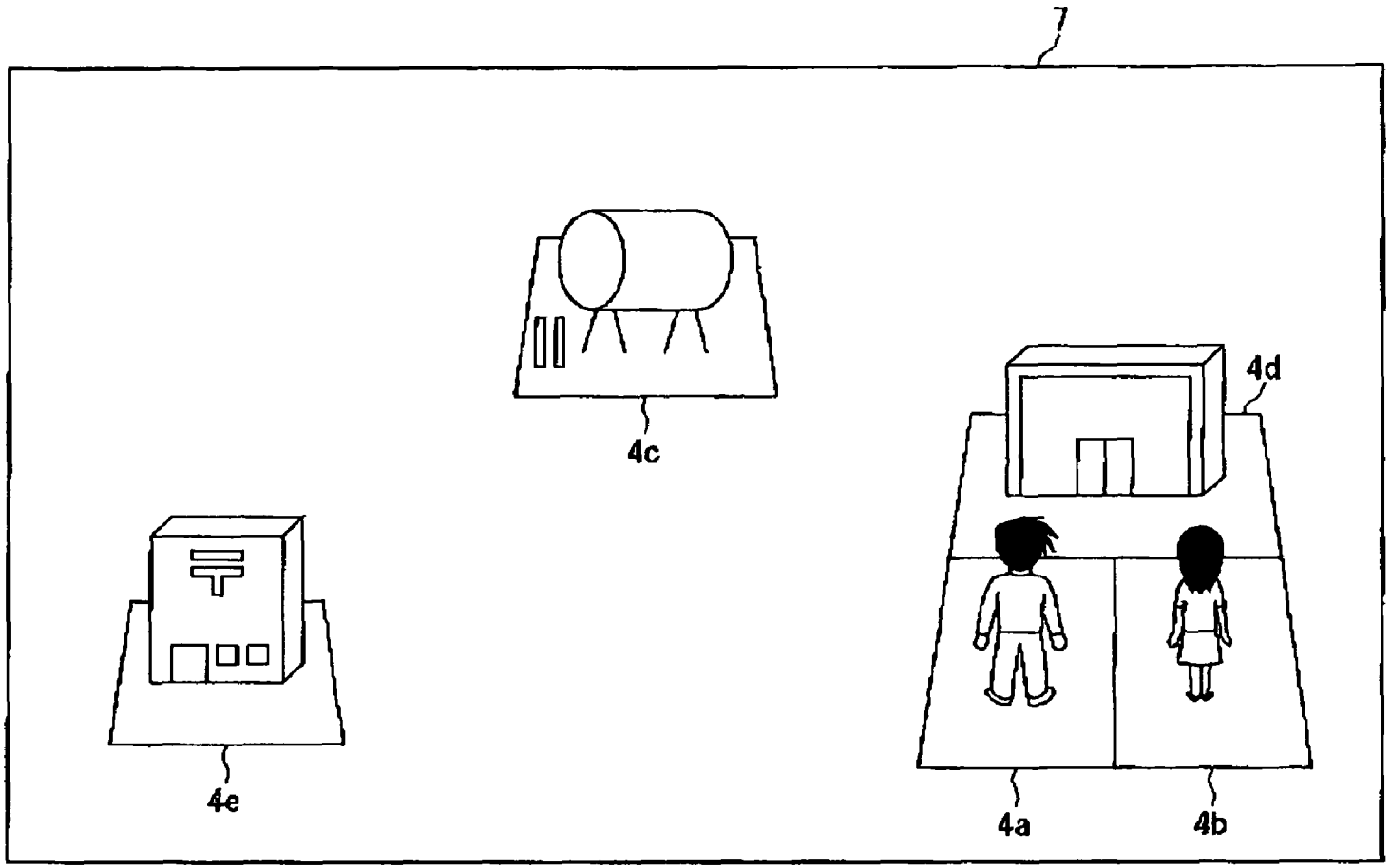
FIG. 16 shows the state which follows the state shown in FIG. 15 and in which two cards come into contact with another card.

FIG. 16 shows the state which follows the state of FIG. 15 and in which two cards are placed so that they are in contact with another card. The left side of the game card 4*d* contacts the front side of the game card 4*a* and the front side of the game card 4*b*. Identification information and orientation of the contacting game card are set as, a condition to read a display pattern as described above. In stage 1, moving characters the man and the woman in front of the restaurant, as shown in FIG. 16, is set as the condition to end stage 1 and proceed to stage 2. Being informed of the positional relation among the game card 4*a*, 4*b*, and 4*c* as shown in FIG. 16 from the positional relation detector 310, the condition evaluator 312 determines that the front side of the game card 4*a* and 4*b* are in contact with the left side of the game card 4*d* and reports it to the game progress processor 302. On receiving the report, the game progress processor 302 recognizes that a closing condition for stage 1 is fulfilled and performs a switching process of game stages. The condition evaluator 312 may determine the fulfillment of the closing condition. The game progress processor 302 reports a subsequent stage name (stage 2), to the character determiner 304.

On receiving the name of the stage, the character determiner 304 reads three-dimensional image data of identification information allotted for stage 2, referring to a corresponding relation shown in FIG. 13. In this way, by changing corresponding relations depending on stages to which the character determiner 304 refers, a new character is able to be presented for each stage, that makes a game story beefed up. In stage 2, a character "restaurant door", a character "waiter", a character, "a table and chairs" are allotted to the game card 4 of identification information 3, the game card 4 of identification information 4 and the game card 4 of identification information 5, respectively as shown in FIG. 13. The display mode of characters shown in FIG. 16 are replaced.

In the game system 201 according to the second embodiment, a variety of image processing technologies are realized other than the one described above by using a positional relation of game card images.

Figure 17A:
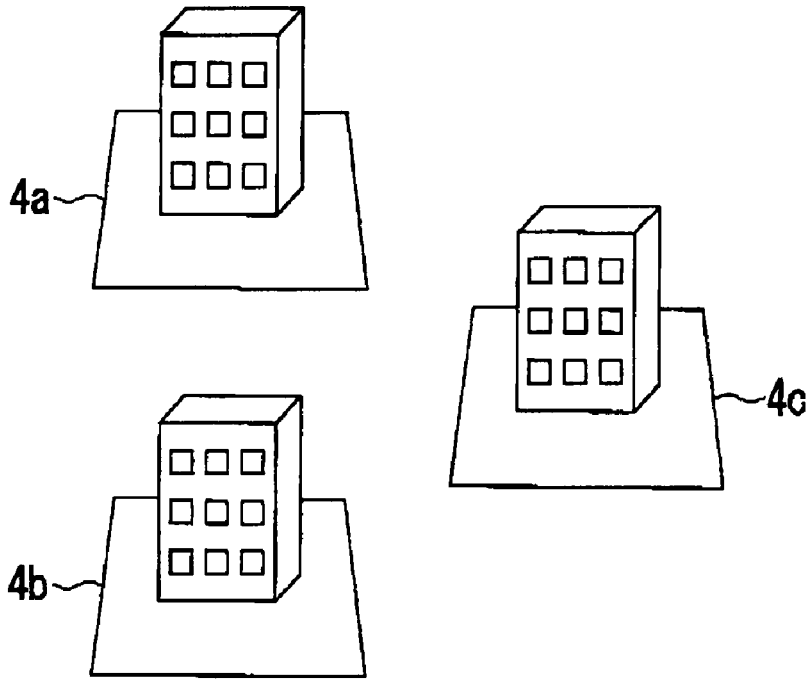
FIG. 17 is a line drawing illustrating a process wherein one character is allotted to plurality of game card images.
Figure 17B:
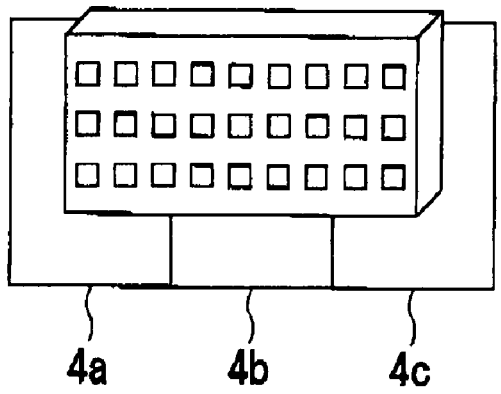

FIG. 17 illustrate a process in which one character is allotted to a plurality of game card images. FIG. 17A shows a state in which a building is allotted for each three game card. Although, three buildings allotted to card 4*a*, 4*b* and 4*c* are identical, a character allotted to a card is not a subject of interest in this process. FIG. 17B shows a state in which three game cards are in contact with each other. In this case, one big building is allotted to three game cards.

The display pattern storage 322 stores a display pattern in which one virtual object is allotted to no less than two game card images which fulfill a condition. In this example, the display pattern storage 322 stores identification information on three game card images (identification information 1, 2 and 3) and the display pattern associated with orientation of the contacting part of the game card images. In this process, the condition to read out the display pattern is that orientation of contacting parts is left or right, that is, each game card image is in contact with other game card image on the left side or the right side.

When the condition evaluator 312 determines that game card 4*a*, 4*b* and 4*c* have contact on their left or right side, the determination result, identification information on game card images and orientation of images are provided to display controller 320 via the game progress processor 302. Based on the information, the display controller 320 reads a display pattern from the display pattern storage 322. Based on the display pattern, the display controller 320 performs display processing as shown in FIG. 17B. Through this process, a character can be displayed huge. Thus, a new visual effect can be realized in the game story. Player's manipulation to place game cards in contact with each other leads to an appearance of an unexpected character, which improves amusement of the game.

Figure 18A:
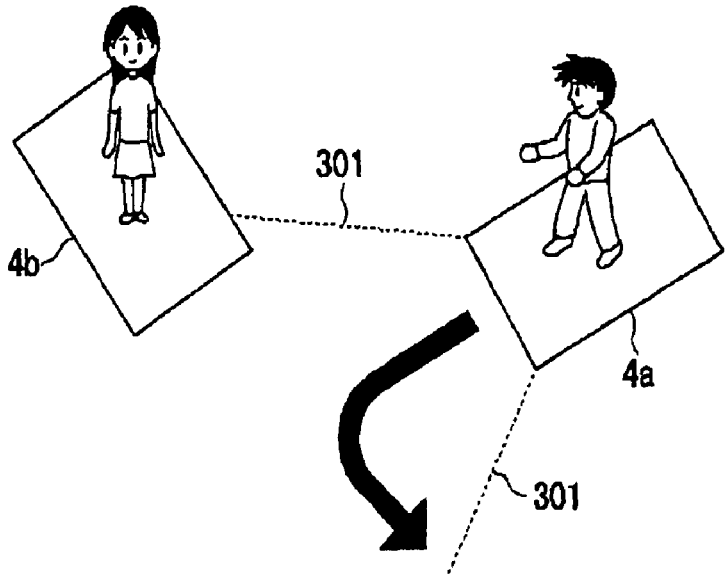
FIGS. 18A and 18B are line drawings illustrating a process wherein orientation of a character is changed.

FIG. 18AB explain a process in which orientation of a character is changed. FIG. 18A indicates a positional relation between the character "man" on the game card 4*a* and the character "woman" on the game card 4B. Two dashed lines 301 extending from the "man" indicate the virtual viewing angle of the man. The condition evaluator 312 determines whether the image of the game card 4*b* is within the virtual viewing angle of the game card 4*a* based on position information and orientation information on the game card 4*a* and position information on the game card 4*b*. Position information and orientation information are delivered from the positional relation detector 310. In determining that the character "woman" is within a virtual viewing angle, the determination result and identification information on game card 4*a* and 4*c* are transferred to the game progress processor 302. It is assumed that the game card 4*a* is moved along a path shown as an arrow by subsequent player's manipulation.

Figure 18B:
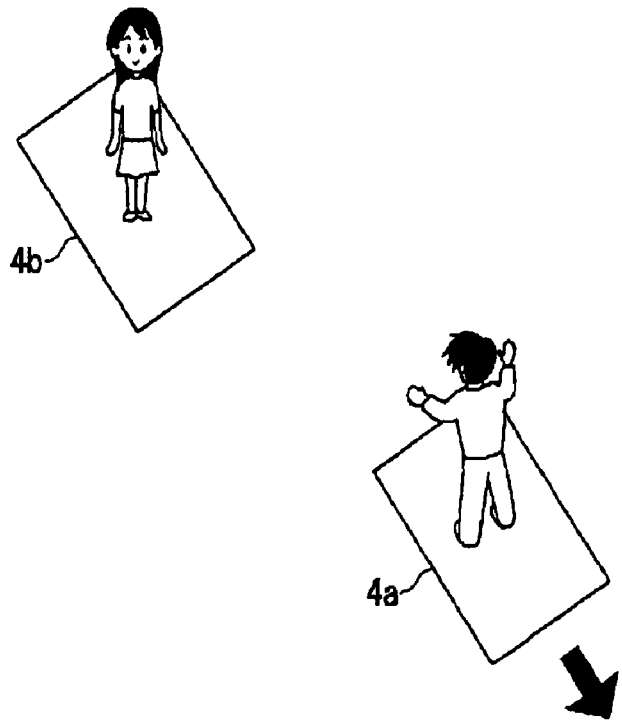

FIG. 18B shows a state after the card is moved along the arrow shown in FIG. 18B. Although the character on the game card 4*a* is set to face forward originally, he faces toward the character on the game card 4*b* in this example. The display controller 320 receives identification information on the game card 4*a* and the 4*b* and information indicating that the game card 4*b* is within the viewing angle of the game card 4*a* from the game progress processor 302. The display pattern storage 322 stores the motion pattern in which the character on the game card 4*a* turns so that he continues to look at the character on game card 4*b*. This display pattern is set to be readable when the condition related to the game cards and the condition related to the viewing angle are established. The display controller 320 reads out the motion pattern and performs display processing as shown in FIG. 18B. That is, the display controller 320 changes the orientation of the character on the game card 4*a*, depending on the position of the character on the game card 4*b*. Through this process, the player recognizes that the character on the game card 4*b* may have an important influence on game progress for a character on the game card 4*a*. A display mode like this gives a player a chance to generate an event by placing the game card 4*a* in contact with the game card 4*b*.

Figure 19A:
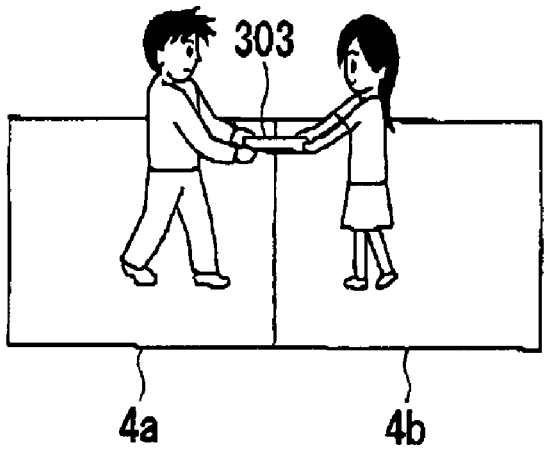
FIGS. 19 A and 19B are line drawings illustrating a process wherein a virtual extendable object is displayed.
Figure 19B:
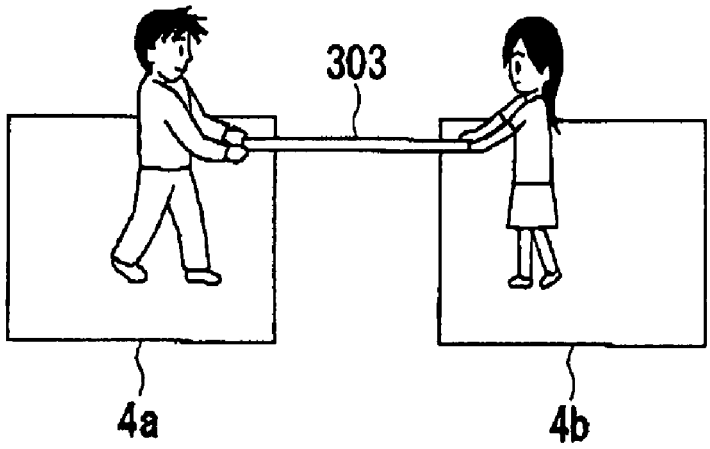

FIG. 19AB illustrate a process in which a virtual object expands and contracts when displayed. FIG. 19A shows a state in which the game card 4*a* and the game card 4*b* are in contact with each other. By making two game cards in contact with each other, a virtual object 303 appears between characters. This virtual object 303 is represented as if it expands, by moving game cards apart as shown in FIG. 19B. On the contrary, a virtual object 303 is represented as if it contracts when game cards are moved close to each other from the state shown in FIG. 19B. This makes it possible to realize a new visual effect. The display pattern storage 322 stores the display pattern in which the virtual object that is extendable depending on positional relation between characters is presented between the characters by making the front sides of the game card 4*a* and the game card 4*b* come into contact with each other.

When the positional relation detector 310 detects that the positional relation between game card images changes from the first state to the second state, the display controller 320 reads out a display pattern in which the virtual object connecting characters associated with respective identification information is displayed as if it extends or contracts from the display pattern storage 322 and determines the motion pattern. The display controller 320 performs display as shown in FIGS. 19A and 19B, using the display pattern.

Figure 20:
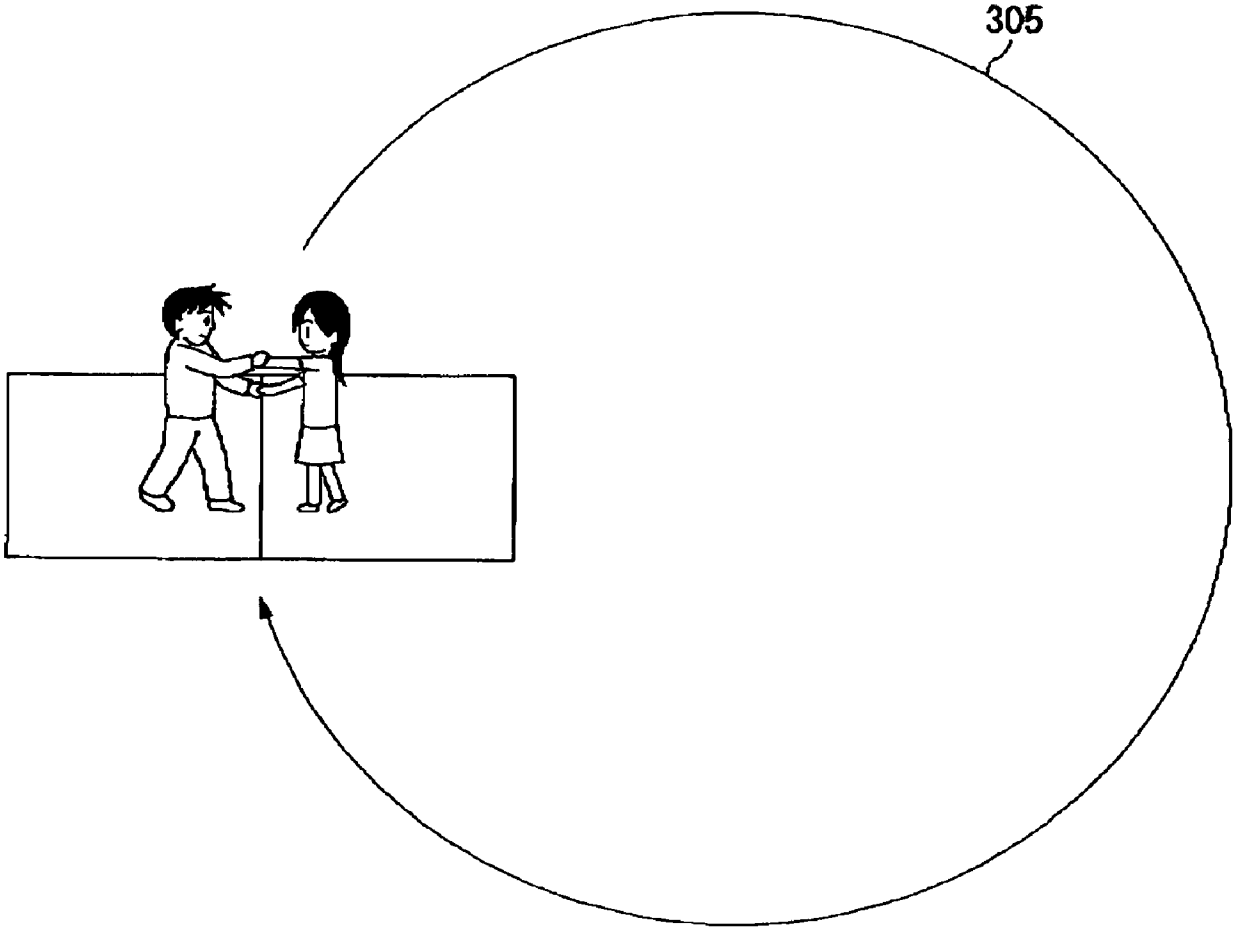
FIG. 20 shows a state wherein a player is given a task.

FIG. 20 shows a state in which a task is presented to a player to make the game more amusing. The task is, for example, to move two game cards 4 on the table 3 along the arrow 301 indicated on the display 7. Two game cards 4 should maintain contact with each other during the movement. The positional relation detector 310 calculates respective movement vectors of the game card 4*a* and 4*b* and defines the average of two vectors as the moving direction of the two game cards. The movement vector is computed by storing central coordinates and distance information of the game card images for each frame into a memory (not shown) and calculating distance change and difference in central coordinates of the game card 4 in consecutive frames. The condition evaluator 312 determines whether the task is achieved from the movement vector. More specifically, the condition evaluator 312 determines whether the movement vector is along the arrow 305. If the direction of the vector and the arrow 205 are substantially identical, the task is cleared. Player may receive an optional merit in the game by clearing the task.

Figure 21:
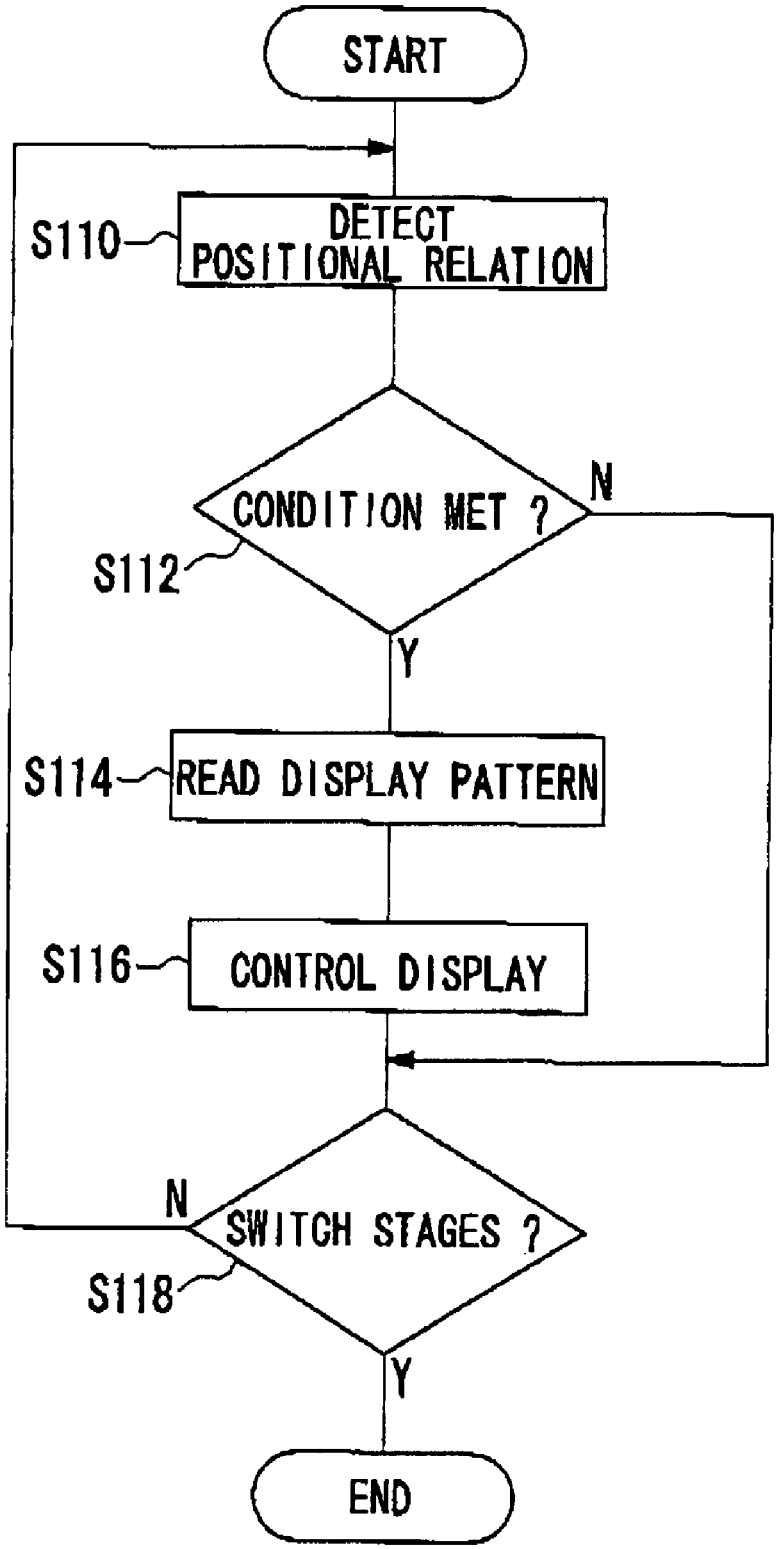
FIG. 21 is a flowchart of an image analysis.

FIG. 21 shows a flowchart for an image processing according to the second embodiment. In the game apparatus 230, the positional relation detector 310 detects the positional relation among a plurality of game card 4 images included in a frame image captured by the imaging apparatus 2 (S110). Based on the positional relation detected by the positional relation detector 310, the condition evaluator 312 determines whether the positional relation among game cards 4 fulfills a predefined condition (S12). If the predefined condition is fulfilled, (Y in S112) the display controller 320 determines the display pattern associated with the fulfilled condition and reads the display pattern from the display pattern storage 322 (S114). The display controller 320 performs display processing of a character using the determined display pattern (S116).

While the predefined condition is not fulfilled (N in S112) and the stage continues (N in S118), the positional relation detector 310 continues to detect the positional relation among game cards 4. In case the stages are changed (Y in S118), the present flow ends. When the subsequent stage begins, three-dimensional image data of a character corresponding to the stage is read out and the flow described above is performed.

The present invention is explained above according to the second embodiment. The second embodiment is only illustrative in nature and it will be obvious to those skilled in the art that variations in constituting elements and processes are possible and that those variations are within the scope of the present invention.

In the second embodiment described above, a character is controlled when displayed, based on the positional relation among game cards 4. To make the game application more interesting and exciting, not only a display mode of the character but also, for example, voice may be used for presentation effect. In this case, if the condition evaluator 312 determines that positional relation among game cards 4 fulfills a predefined condition, the game progress processor 302 may reports to a voice controller (not shown), and the voice controller may direct an auditory presentation effect of the character through a speaker. In this case the game apparatus 230 functions not only as an image processing apparatus but also as a voice processing apparatus. Thus the game apparatus 230 may be referred to as a processor which is able to control both image and voice. The game apparatus 230 may control only voice depending on positional relation among game cards 4.

The present invention is explained above according to a plurality of embodiments. These exemplary embodiments is only illustrative in nature and it will be obvious to those skilled in the art that variations in constituting elements and processes are possible and that those variations are within the scope of the present invention. While the first and the second embodiments of the present invention are described above, combination of respective contents of the embodiments enables to control a display mode of a virtual object more effectively.

INDUSTRIAL APPLICABILITY

The present invention is applicable to a field of image processing.

The invention claimed is:

1. An image processing apparatus comprising:

a storage which stores identification information for identifying a real object and three-dimensional image data of a virtual object associated with each other;

a reader which reads three-dimensional image data of a virtual object associated with identification information on an image of a real object included in a frame image captured by an imaging apparatus from the storage;

a display controller which displays the virtual object on a display in association with a displayed position of the real object using read three-dimensional image data; and a change detector which detects a temporal state change of images of the real object captured by the imaging apparatus, wherein the display controller superimposes the virtual object on the displayed position of the real object in such a manner that the real object is visible on the display and controls the virtual object as displayed based on the state change detected by the change detector, the change detector includes a movement quantity monitoring unit which monitors movement quantity of the real object captured by the imaging apparatus, and the display controller does not make the virtual object follow the real object in case the movement velocity of the real object is determined to exceed a predetermined reference velocity by the movement quantity monitoring unit.

2. The image processing apparatus according to claim 1 wherein the display controller stops the movement of the virtual object so that the virtual object is not superimposed on the displayed position of the real object.

3. The image processing apparatus according to claim 1, wherein when the displayed position of the real object and the displayed position of the virtual object are apart, the display controller moves the virtual object to the displayed position of the real object at a point of time.

4. The image processing apparatus according to claim 1, wherein the display controller changes a motion pattern of the virtual object in case the real object is detected to shuttle to and fro by the movement quantity monitoring unit.

5. The image processing apparatus according to claim 1, wherein the change detector includes an existence recognizer which, in case the real object is not recognized in a predetermined number of consecutive frame images, determines that the real object is not captured by the imaging apparatus and the display controller makes the virtual object disappear from the screen of the display in case the real object is determined not to be captured by the existence recognizer.

6. The image processing apparatus according to claim 1, wherein the change detector includes an existence recognizer which, in case the real object is not recognized in a predetermined number of consecutive frame images, determines that the real object is not captured by the imaging apparatus and the display controller displays a new virtual object on the display in case it is determined by the existence recognizer that a state in which the real object is captured and a state in which the real object is not captured are repeated alternately.

7. The image processing apparatus according to claim 1, wherein the change detector includes a rotation detector which detects a rotation of the real object, and the display controller changes a motion pattern of the virtual object in case the rotation of the real object is detected by the rotation detector.

8. The image processing apparatus according to claim 1, further comprising an orientation determiner which determines an orientation of the real object, wherein the display controller displays an additional virtual object and is triggered by the detection of state change of the real object by the change detector to move the additional virtual object in the direction determined by the orientation determiner, so that the additional virtual object moves apart from the virtual object.

9. The image processing apparatus according to claim 1, further comprising:

an attitude determiner which determines an attitude of the real object; and an orientation determiner which determines an orientation in which the real object is inclined using the determined attitude, wherein the display controller displays an additional virtual object and moves the additional virtual object in the direction determined by the orientation determiner, so that the other virtual object moves apart from the virtual object.

10. The image processing apparatus according to claim 1 further comprising:

a positional relation detector which detects a positional relation among a plurality of real object images included in a frame image captured by an imaging apparatus based on a state change detected by the change detector; and a condition evaluator which determines whether the detected positional relation among at least two of real object images fulfills a predefined condition; wherein the display controller, in case the condition evaluator determines that the predefined condition is fulfilled, determines a display pattern of the virtual objects based on identification information on at least two real object images which fulfill the predefined condition and controls the virtual objects as displayed according to the determined display pattern, using a plurality of pieces of read three-dimensional image data.

11. The image processing apparatus according to claim 10, wherein the display pattern is such that a motion pattern among the virtual objects associated with identification information on no less than two real object images which fulfill the predefined condition is determined.

12. The image processing apparatus according to claim 10, wherein the display pattern is such that one virtual object is allotted to no less than two real object images which fulfill the predefined condition.

13. The image processing apparatus according to claim 10, wherein the condition evaluator determines whether the real object images are in contact with each other.

14. The image processing apparatus according to claim 13, wherein the condition evaluator recognizes the orientation of the real object images in determining whether the contact occurs.

15. The image processing apparatus according to claim 10, wherein the storage stores a plurality of correspondences between identification information for identifying a real object and three-dimensional image data of a virtual object, and the reader reads three-dimensional image data based on identification information, referring to another correspondence in the storage, when the predefined condition is determined to be fulfilled by the condition evaluator.

16. The image processing apparatus according to claim 10, wherein the display controller changes the orientation of a virtual object corresponding to one real object image based on a position of a virtual object corresponding to another real object image, when the predefined condition is determined to be fulfilled by the condition evaluator.

17. The image processing apparatus according to claim 10, wherein when the positional relation among real objects detected by the positional relation detector shifts from a first state to a second state, the display controller determines a display pattern in which a virtual object connecting virtual objects, which correspond to the identification information of respective real object images, is extended or contracted between the virtual objects.

18. The image processing apparatus according to claim 10, wherein the condition evaluator determines whether a predetermined task is achieved from a movement vector of the real object image.

19. A game apparatus comprising:

a storage which stores identification information for identifying a real object and three-dimensional image data of a game character associated with each other;

a reader which reads three-dimensional image data of a game character associated with identification information on an image of a real object included in a frame image captured by an imaging apparatus from the storage;

a display controller which displays the game character on a display in association with a displayed position of the real object using read three-dimensional image data; and a change detector which detects a temporal state change of images of the real object captured by the imaging apparatus, wherein the display controller superimposes the game character on the displayed portion of the real object in such a manner that the real object is visible on the display and controls the game character as displayed based on the state change detected by the change detector, the change detector includes a movement quantity monitoring unit which monitors movement quantity of the real object captured by the imaging apparatus, and the display controller does not make the game character follow the real object in case the movement velocity of the real object is determined to exceed a predetermined reference velocity by the movement quantity monitoring unit.

20. The game apparatus according to claim 19, wherein when game progress is constituted by a plurality of stages, the storage stores identification information for identifying a real object and three-dimensional image data of a game character associated with each other, for each stage.

21. The game apparatus according to claim 19 further comprising:

a positional relation detector which detects a positional relation among a plurality of real object images included in a frame image captured by an imaging apparatus based on a state change detected by the change detector;

a condition evaluator which determines whether the detected positional relation among at least two of real object images fulfills a predefined condition; wherein the display controller, in case the condition evaluator determines that the predefined condition is fulfilled, determines a display pattern of the game characters based on identification information on at least two real object images which fulfill the predefined condition and controls the game characters as displayed according to the determined display pattern, using a plurality of pieces of read three-dimensional image data.

22. The game apparatus according to claim 21, wherein when game progress is constituted by a plurality of stages, the storage stores identification information for identifying a real object and three-dimensional image data of a game character associated with each other, for each stage.

23. An image processing method, comprising:

reading three-dimensional image data of a virtual object associated with identification information on an image of a real object included in a frame image captured by an imaging apparatus from a storage which stores identification information for identifying a real object and three-dimensional image data of a virtual object associated with each other;

displaying the virtual object on a display in association with a displayed position of the real object, using read three-dimensional image data;

detecting a temporal state change of images of the real object captured by the imaging apparatus and monitoring movement quantity of the real object;

controlling the virtual object as displayed based on the detected state change in addition to superimposing the virtual object on the displayed position of the real object in such a manner that the real object is visible on the display; and not making the virtual object follow the real object in case the movement velocity of the real object is determined to exceed a predetermined reference velocity.

24. The image processing method according to claim 23, further comprising:

detecting a positional relation among a plurality of real object images included in a frame image captured by an imaging apparatus based on a state change detected in the change detecting step; and determining whether the detected positional relation among at least two of real object images fulfills a predefined condition; wherein in case the determining determines that the predefined condition is fulfilled, the controlling the virtual object as displayed is such that a display pattern of the virtual objects is determined based on identification information on at least two real object images which fulfill the predefined condition and the virtual objects are controlled as displayed according to the determined display pattern, using a plurality of pieces of read three-dimensional image data.

25. A non-transitory computer-readable recording medium having embodied thereon a computer program product, the program comprising:

a reading module which reads three-dimensional image data of a virtual object associated with identification information on an image of a real object included in a frame image captured by an imaging apparatus from a storage which stores identification information for identifying a real object and three-dimensional image data of a virtual object associated with each other;

a displaying module which displays the virtual object on a display in association with a displayed position of the real object, using read three-dimensional image data;

a detecting module which detects a temporal state change of images of the real object captured by the imaging apparatus and monitors movement quantity of the real object; and a controlling module which superimposes the virtual object on the displayed position of the real object in such a manner that the real object is visible on the display and controls the virtual object as displayed based on the detected state change, wherein the displaying module does not make the virtual object follow the real object in case the movement velocity of the real object is determined to exceed a predetermined reference velocity.

26. The non-transitory computer-readable recording medium having embodied thereon a computer program product according to claim 25, the program further comprising:

a detecting module which detects a positional relation among a plurality of real object images included in a frame image captured by an imaging apparatus based on a state change detected by the change detector; and an evaluating module which determines whether the detected positional relation among at least two of real object images fulfills a predefined condition; wherein the controlling module determines, in case the predefined condition is determined to be fulfilled, a display pattern of the virtual objects based on identification information on at least two real object images which fulfill the predefined condition and controls the virtual objects as displayed according to the determined display pattern, using a plurality of pieces of read three-dimensional image data.

* * * * *